US012398622B2

(12) United States Patent
Burrows et al.

(10) Patent No.: US 12,398,622 B2
(45) Date of Patent: Aug. 26, 2025

(54) SYSTEMS AND METHODS FOR DELIVERING FLUID INTO A WELLBORE

(71) Applicant: FLOWCO PRODUCTION SOLUTIONS, LLC, Spring, TX (US)

(72) Inventors: Stephen Burrows, Katy, TX (US); Kevin Cheramie, League City, TX (US); Scott DeYoung, Johnstown, CO (US); Matthew Young, Magnolia, TX (US); Kelly Wells, Bryan, TX (US)

(73) Assignee: Flowco MasterCo LLC, Houston, TX (US)

( * ) Notice: Subject to any disclaimer, the term of this patent is extended or adjusted under 35 U.S.C. 154(b) by 12 days.

(21) Appl. No.: 18/779,708

(22) Filed: Jul. 22, 2024

(65) Prior Publication Data

US 2025/0188819 A1 Jun. 12, 2025

Related U.S. Application Data

(63) Continuation-in-part of application No. 18/536,887, filed on Dec. 12, 2023, now Pat. No. 12,044,105.

(51) Int. Cl.
*E21B 34/14* (2006.01)
*E21B 33/12* (2006.01)

(52) U.S. Cl.
CPC ..... *E21B 34/14* (2013.01); *E21B 33/1208* (2013.01)

(58) Field of Classification Search
CPC ..... E21B 34/14; E21B 33/1208
See application file for complete search history.

(56) References Cited

U.S. PATENT DOCUMENTS 3,687,202 A * 8/1972 Young ..... E21B 33/1294 166/305.1
4,709,760 A * 12/1987 Crist ..... E21B 34/063 175/4.54
5,048,611 A * 9/1991 Cochran ..... E21B 34/142 166/321
5,609,204 A * 3/1997 Rebardi ..... E21B 34/14 166/227
5,765,639 A * 6/1998 Muth ..... E21B 43/127 166/313
5,934,372 A * 8/1999 Muth ..... E21B 33/122 166/313
10,047,589 B2 8/2018 Boyd
(Continued)

*Primary Examiner* — Steven A Macdonald
(74) *Attorney, Agent, or Firm* — Jason P. Mueller; FisherBroyles, LLP

(57) ABSTRACT

A valve assembly for delivering a fluid into a wellbore includes a stationary valve assembly that is installed on a production tube that extends down into the wellbore. A dynamic valve assembly that is attached to a capillary line is lowered into the production tube, and the dynamic valve assembly releasably latched onto the stationary valve assembly. The latching of the dynamic valve assembly to the stationary valve assembly also opens a fluid connection between the dynamic valve assembly and the stationary valve assembly, thereby allowing pressurized fluid to flow from the capillary line into the wellbore via the stationary valve assembly. When it is necessary or desirable to perform maintenance or repair operations on the dynamic valve assembly or the capillary line, the dynamic valve assembly and the attached capillary line can all be withdrawn to the top of the well.

23 Claims, 28 Drawing Sheets

(56) References Cited

U.S. PATENT DOCUMENTS

| | | | | |
|---|---|---|---|---|
| 2002/0066572 | A1* | 6/2002 | Muth | E21B 43/127 166/105 |
| 2004/0206513 | A1* | 10/2004 | St. Clair | E21B 23/02 166/386 |
| 2008/0000642 | A1* | 1/2008 | Mailand | E21B 33/068 166/305.1 |
| 2009/0084553 | A1* | 4/2009 | Rytlewski | E21B 43/08 166/305.1 |
| 2020/0032627 | A1 | 1/2020 | Salihbegovic | |
| 2020/0270967 | A1* | 8/2020 | Fong | E21B 33/1294 |
| 2020/0291750 | A1 | 9/2020 | Hill, Jr. | |
| 2024/0125200 | A1* | 4/2024 | Al-Ramadhan | E21B 33/16 |
| 2024/0229599 | A1* | 7/2024 | Evans | E21B 33/16 |

* cited by examiner

SYSTEMS AND METHODS FOR DELIVERING FLUID INTO A WELLBORE

This application is a continuation-in-part of application Ser. No. 18/536,887, filed Dec. 12, 2023, the content of which is incorporated herein by reference.

BACKGROUND OF THE INVENTION

The invention is related to systems and methods for delivering a fluid chemical into a wellbore. Typically, a capillary line is run from the top of the well down into a desired location or depth within the well. A fluid is then pumped down the capillary line so that the fluid is emitted from the end of the capillary line. In many instances, an injection valve is attached to the end of the capillary line. The injection valve operates to control the rate at which fluid is emitted and to prevent fluids within the wellbore from entering the capillary line.

The pressure of the fluid within a wellbore increases with depth. The pressure of the fluid in the capillary line must be greater than the pressure of the fluid within the wellbore at the depth at which the fluid is emitted from the capillary line. As a result, it is necessary to use a pump to pressurize the fluid delivered into the capillary line so that the fluid can be emitted from the end of the capillary line.

Typically a production tube extends down into the wellbore. A capillary line used to deliver a fluid into a wellbore is often attached to the outer surface of the production tube via clips, bands or some other sort of attachment mechanism. Unfortunately, it is common for corrosion to occur at the interface between the capillary line and the exterior of the production tube. The corrosion can occur due to the contact between the attachment mechanism, the capillary line and the production tube, due to the pressure applied by a clamp in order to attach the capillary line to the production tube, and as a result of a cathodic corrosion which can occur when two different materials such as carbon steel and chromium steel are brought into engagement. The engagement between the capillary line the attachment mechanism and the production tube also can limit access of a corrosion inhibitor, making corrosion more of an issue. Moreover, the wellbore itself is typically a corrosive environment and is typically filled with various chemicals that exist at high pressures and elevated temperatures. All of these effects can result in a capillary line or tubing leaking or becoming clogged or damaged over time.

When production tubing fails or becomes impaired, it is difficult and expensive to replace. Similarly, when the capillary line is attached to the production tube, it is impossible to conduct any sort of maintenance on an injection valve attached to the end of the capillary line without removing the production tube.

DETAILED DESCRIPTION OF PREFERRED EMBODIMENTS

The following detailed description of preferred embodiments refers to the accompanying drawings, which illustrate specific embodiments of the invention. Other embodiments having different structures and operations do not depart from the scope of the present invention.

The systems and methods disclosed herein allow for a fluid capillary line attached to a dynamic valve assembly to be run down the interior of a production tube and to be releasably latched onto a stationary valve assembly mounted on the production tube. While the dynamic valve assembly is latched to the stationary valve assembly, fluid within the capillary line can be delivered through the dynamic valve assembly into the stationary valve assembly. The stationary valve assembly can then deliver the injection fluid to a location outside the production line.

When it is necessary or desirable to perform maintenance or repair operations on the capillary line or the dynamic valve assembly, the dynamic valve assembly can be unlatched from the stationary valve assembly, and the capillary line and the attached dynamic valve assembly can be withdrawn up to the top of the well and removed from the production tube.

This type of arrangement eliminates the need to clamp a capillary line to the exterior production tubing. As a result, corrosion caused by clamping the capillary line to the production tube or due to cathodic or fretting reaction is largely eliminated. This also makes it possible to perform maintenance and repair operations on the capillary line and the attached dynamic valve assembly without the need to remove the production tube from the well.

Figure 1A:
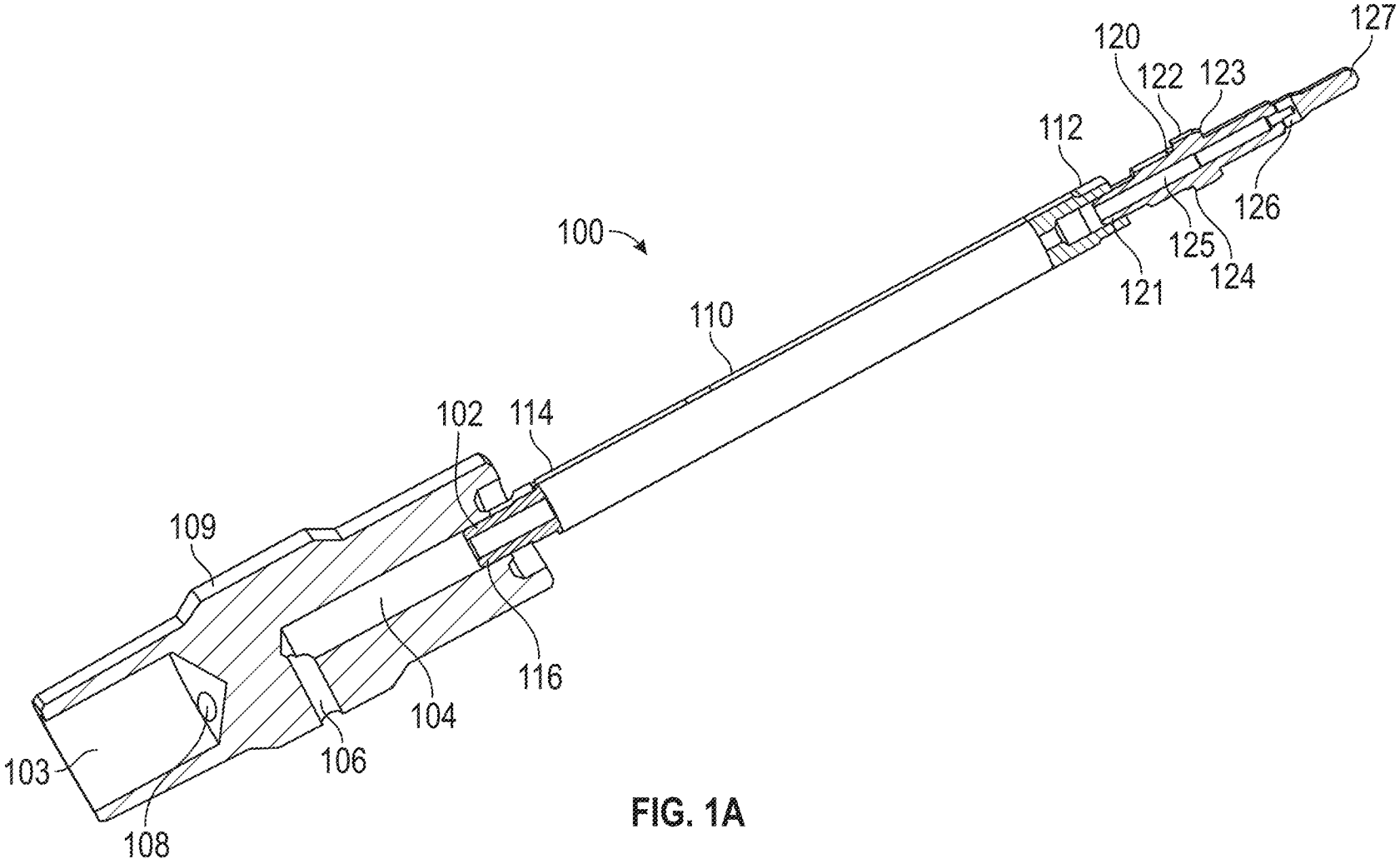
FIG. 1A is a sectional view of a stationary valve assembly.
Figure 1B:
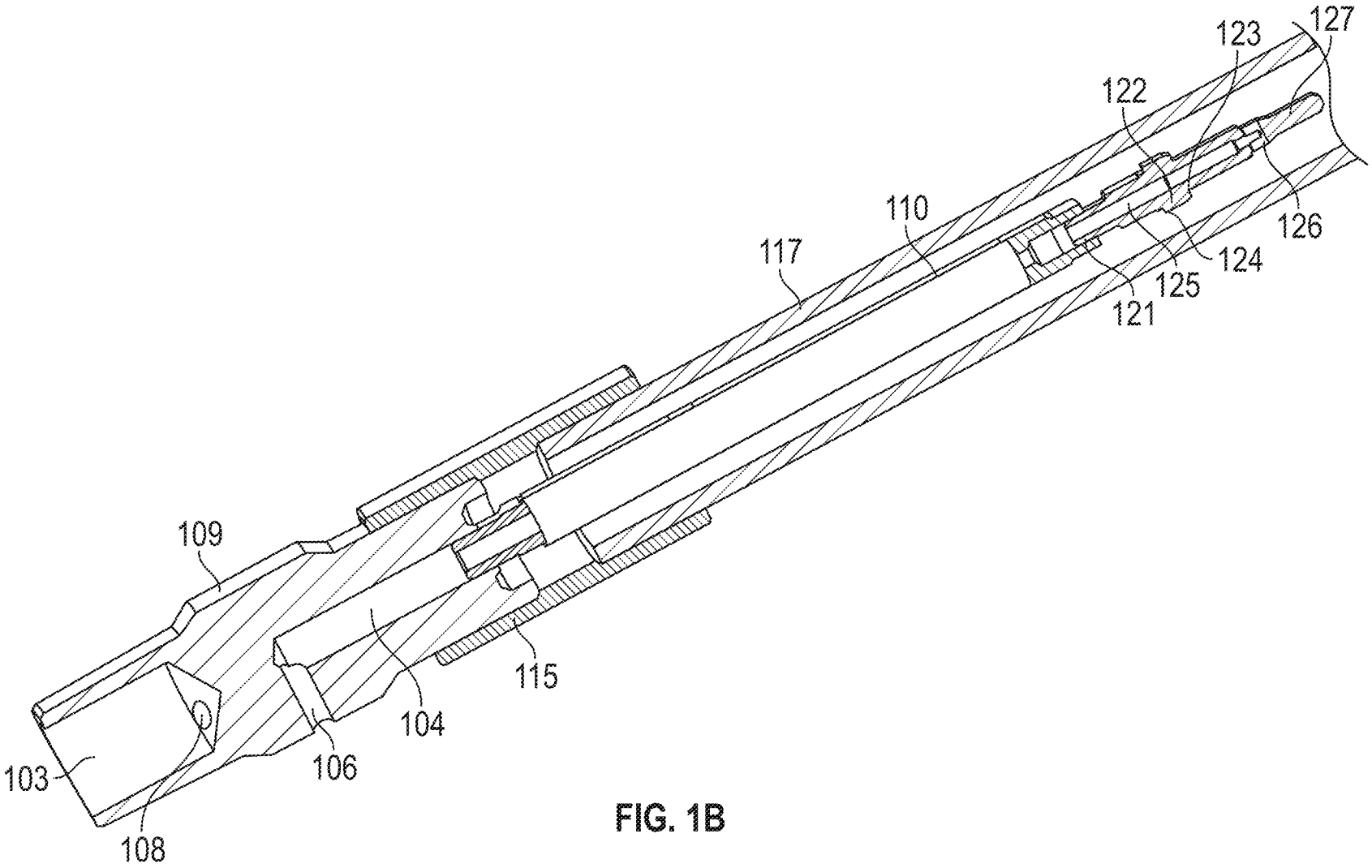
FIG. 1B is a sectional view of a stationary valve assembly mounted to a production tube.

FIG. 1A illustrates elements of a stationary valve assembly 100 that would be attached to a production tube that extends down into a wellbore. The stationary valve assembly 100 could be attached to the bottom of the production tube, or possibly to an interim portion of the production tube that is located part of the way down the full depth of a wellbore. FIG. 1B illustrates the stationary valve assembly attached to and end of a production tube 117 such that most of the stationary valve assembly is located inside the production tube 117.

The stationary valve assembly 100 includes a seating nipple 109 that is secured to the end of the production tube 117 via a collar 115. The seating nipple 109 includes an axial fluid passageway 104 which connects with a radial fluid passageway 106 that extends out to the side of the seating nipple 109. Fluid delivered to the upper end of the axial fluid passageway 104 can be emitted through the radial passageway 106, which ensures that the fluid is delivered outside the production tubing 117.

Figure 1C:
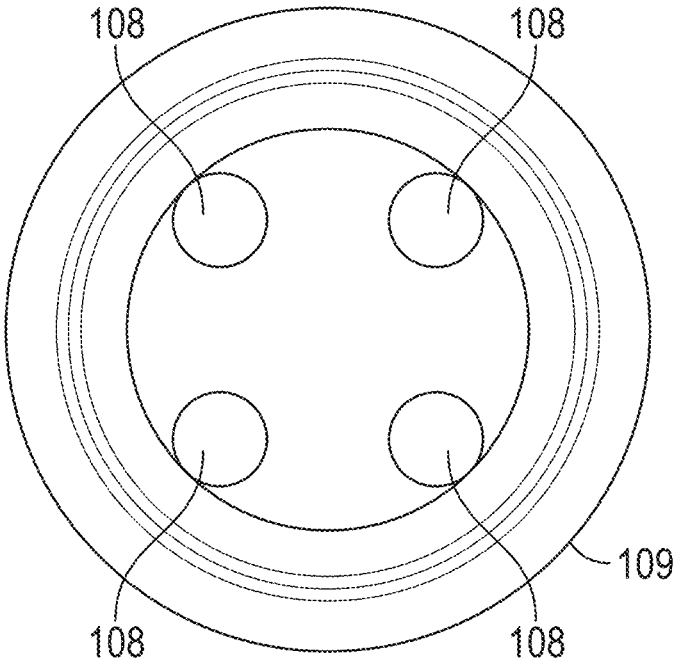
FIG. 1C is a bottom view of a seating nipple mounted to the end of a production tube.

One or more vent holes 108 can be cut or formed through the length of the seating nipple 109 so that fluid and particles inside the production tube 117 can fall out the bottom of the production tube 117 via the vent holes 108. This helps to prevent particles from collecting at the bottom of the production tube 117, which could interfere latching a dynamic valve assembly to the stationary valve assembly. FIG. 1C illustrates the bottom of the seating nipple 109, which illustrates how the vent holes 108 pass through the length of the seating nipple 109. In the embodiment illustrated in FIGS. 1A-1C, the bottom portion of the seating nipple 108 includes a cylindrical wall that forms a vent passageway 103 to shield the vent holes 108, and to ensure that the vent holes remain open.

The stationary valve assembly also includes an injection valve 110. The injection valve includes a threaded rear connector 116 at the lower end of the injection valve 110 which is screwed into a threaded receiving connector 102 at the top of the seating nipple 109. The injection valve 110 essentially operates as a check valve, allowing fluid to flow down into the seating nipple 109 and then out into the wellbore, but preventing fluid located in the axial flow passageway 104 of the seating nipple 109 from flowing upward into a capillary line when the capillary line is latched onto the seating nipple assembly.

A dart 120 is connected to an upper end of the injection valve 110. In some embodiments, a threaded rear connector 121 on the dart 120 is screwed into a receiving threaded hole 112 at the top of the injection valve 110. The dart 120 operates to open or close a valve located on a dynamic valve assembly, as will be explained in greater detail below.

The dart 120 includes an axial fluid passageway 125 which extends along a portion but not all of the length of the dart 120. The axial fluid passageway 125 is connected to radial fluid passageways 126 which extend outward to the exterior surface of the dart 120. The upper end of the dart includes a tip 127 which is used to open a valve on a dynamic valve assembly, as described below. In addition, the dart 120 includes an outwardly protruding annular ridge 122 which includes both a leading shoulder 123 and a trailing shoulder 124.

Figure 2:
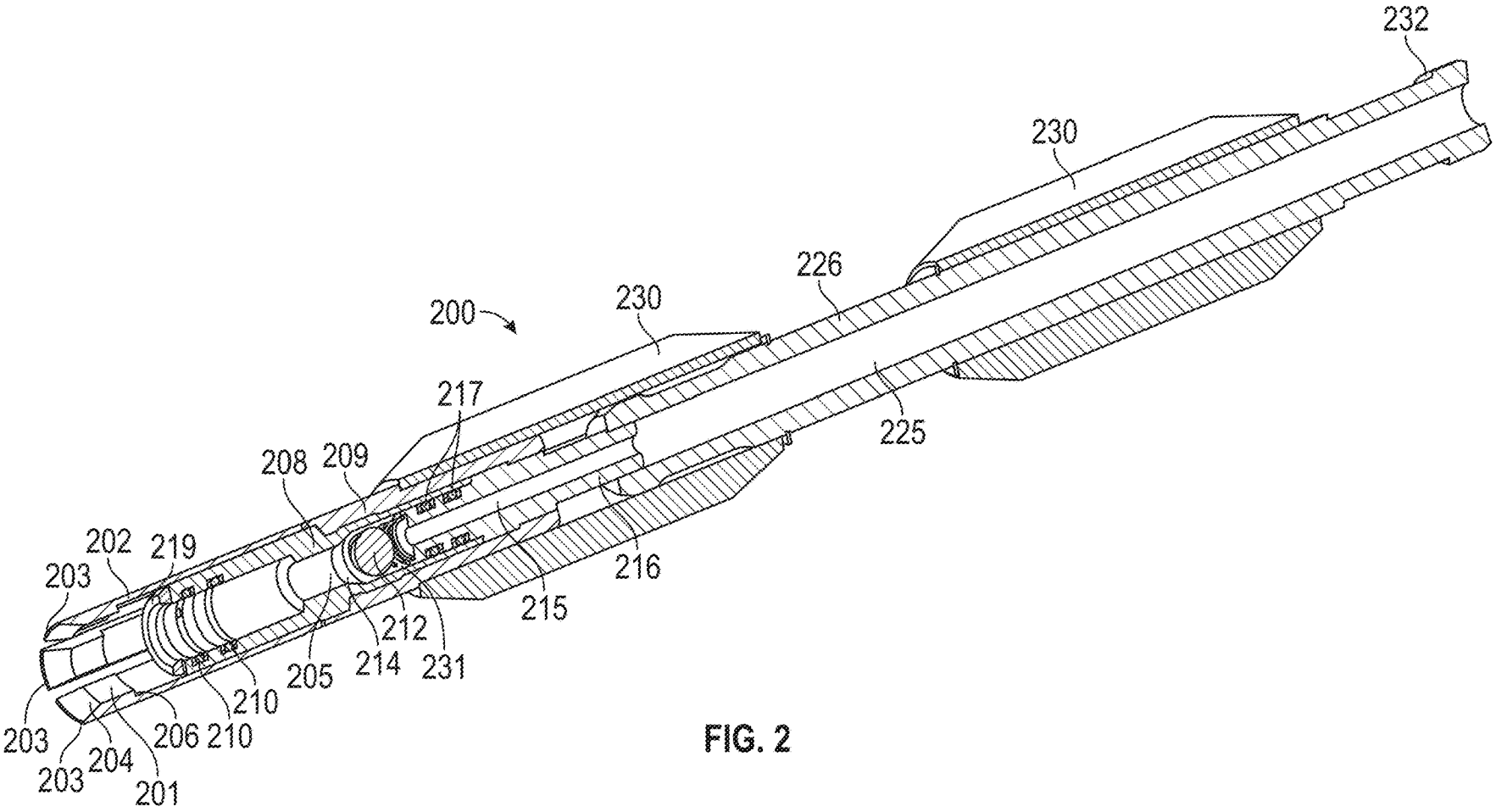
FIG. 2 is a sectional view of a dynamic valve assembly.

FIG. 2 illustrates a dynamic valve assembly 200 which would be attached to the bottom of a capillary line which is to be run down the interior of a production tube 117. The dynamic valve assembly is configured to removably latch onto a stationary valve assembly, such as the one illustrated in FIGS. 1A-1C.

The dynamic valve assembly 200 includes a housing 208, which includes a fluid receiving passageway 231 and a fluid delivery passageway 205 that are separated by a valve seat 214. A valve element, which in this embodiment is a ball 212, is movably mounted within the receiving fluid passageway 231. The lower end of the housing can include a seating shoulder 219 which is configured to bear against the leading edge 123 of the annular ridge 122 of the dart 120 when the dart 120 is inserted into the housing 208, as will be described in more detailed below. In some embodiments, an elastic or cushioning member may be inserted into the housing 208 and act as the seating shoulder 219.

Figure 3:
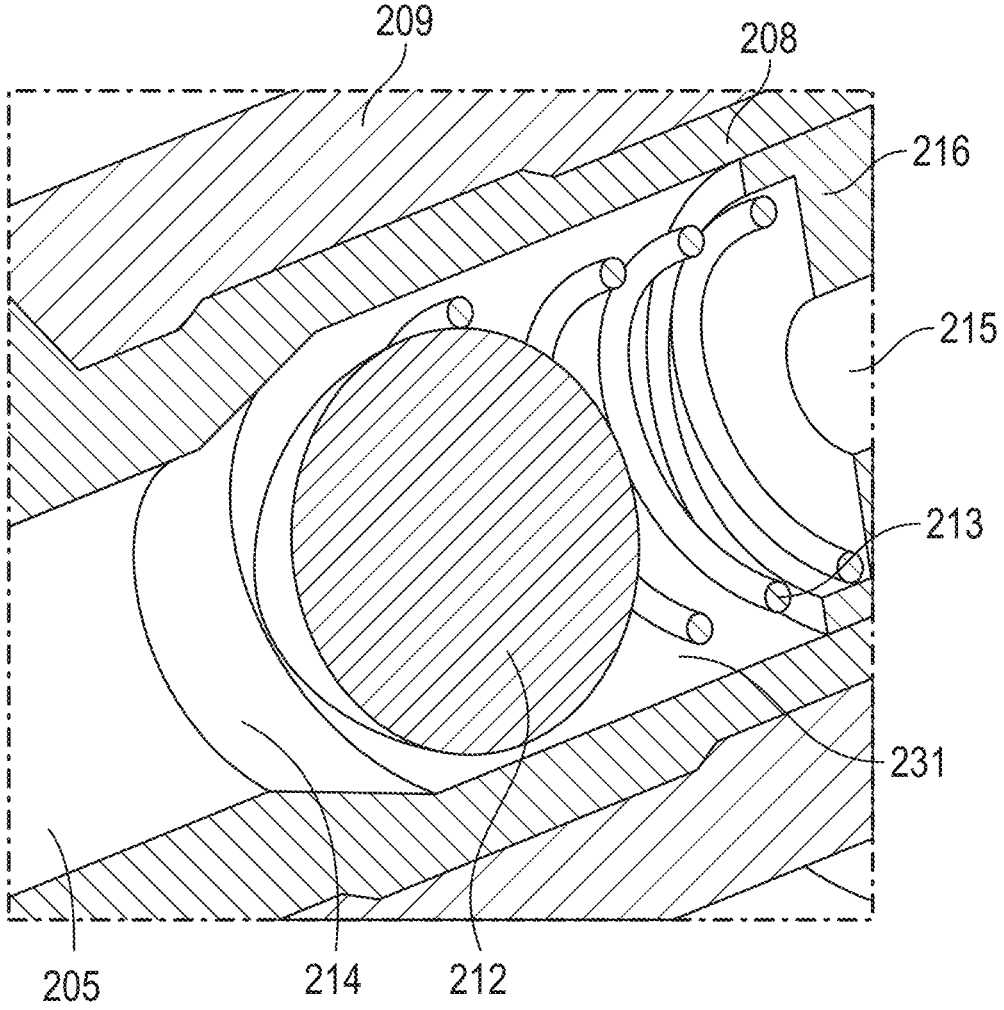
FIG. 3 is an enlarged sectional view of a portion of a dynamic valve assembly.

FIG. 3 provides an enlarged view of a portion of the housing 208 of the dynamic valve assembly 200. As shown in FIG. 3, the valve seat 214 is located between the fluid receiving passageway 231 and the fluid delivery passageway 205. A biasing element 213, which in this embodiment is a spiral spring, urges the ball 212 into engagement which the valve seat 214 to keep the fluid receiving passageway 231 isolated from the fluid delivery passageway 205.

As illustrated in FIG. 2, a housing connector 209 couples a cap 216 to the upper end of the housing 208. The cap 216 includes an axial fluid passageway 215 which extends down the central longitudinal axis of the cap 216. Two rear seals 217 form a fluid tight seal between the exterior cap 216 and the interior of the housing 208.

A weight bar 226 is attached to the upper end of the cap 216. The weight bar 226 also includes an axial fluid passageway 225 which extends down its longitudinal axis. The purpose of the weight bar 226 is to provide weight at the end of the capillary line to which the dynamic valve assembly 200 is attached. The weight of the weight bar 226 provides a downward force that is used to help latch the dynamic valve assembly 200 to a stationary valve assembly, as will be described in greater detail below. Centralizers 230 can be located around various portions of the dynamic valve assembly 200, including the housing 205 and the weight bar 226. The centralizers 230 help to keep the dynamic valve assembly 200 centered in the production tube 117 through which it is run.

The lower end of the dynamic valve assembly 200 includes a collet 202 which is attached to a lower end of the housing 208. The collet 202 includes a plurality of prongs 203 which are sufficiently flexible that they can bend outwards and then return to the positions illustrated in FIG. 2. The prongs 203 of the collet 202 are used to help latch the dynamic valve assembly 200 to a stationary valve assembly, as will be described below.

One or more forward seals 210 are also provided on the interior of the lower section of the housing 208. The lower seals 210 act to form a fluid tight seal between the interior of the housing 208 and an exterior of a dart on a stationary valve assembly, as is described below.

The upper end of the weight bar 226 of the dynamic valve assembly 200 is attached to a bottom end of a capillary line. The capillary line can then deliver pressurized fluid into the axial flow passageway 225 of the weight bar 226, through the axial flow passageway 215 of the cap 216 and into the receiving fluid passageway 231 of the housing 208. The ball 212 pressed against the valve seat 214 of the housing 208 by the spring 213 prevents the pressurized fluid from escaping the housing 208 until the dynamic valve assembly 200 has been latched onto a stationary valve assembly.

Once the dynamic valve assembly 200 has been attached to a capillary line that delivers pressurized fluid, the capillary line and the attached dynamic valve assembly 200 are lowered down a production tube 117 that extends down into a wellbore. The bottom of the dynamic valve assembly 200 is then lowered onto and latched to a stationary valve assembly 100 mounted on the production tube 117, such as the one illustrated in FIG. 1B. This involves lowering the dynamic valve assembly 200 such that the housing 208 receives the dart 120 at the top of the stationary valve assembly 100. The prongs 203 of the collet 202 interact with the annular ridge on the dart 120 to releasably latch the dynamic valve assembly 200 to the stationary valve assembly 100.

Latching the dynamic valve assembly 200 onto the dart 120 at the top of the stationary valve assembly 100 causes the valve within the housing 208 of the dynamic valve assembly 200 to open so that fluid in the receiving fluid passageway 231 of the housing can flow into the axial fluid passageway 125 of the dart 120 via the radial fluid passageways 126 of the dart 120. The latching process, which results in the valve opening, is described in greater detail below.

Figure 4:
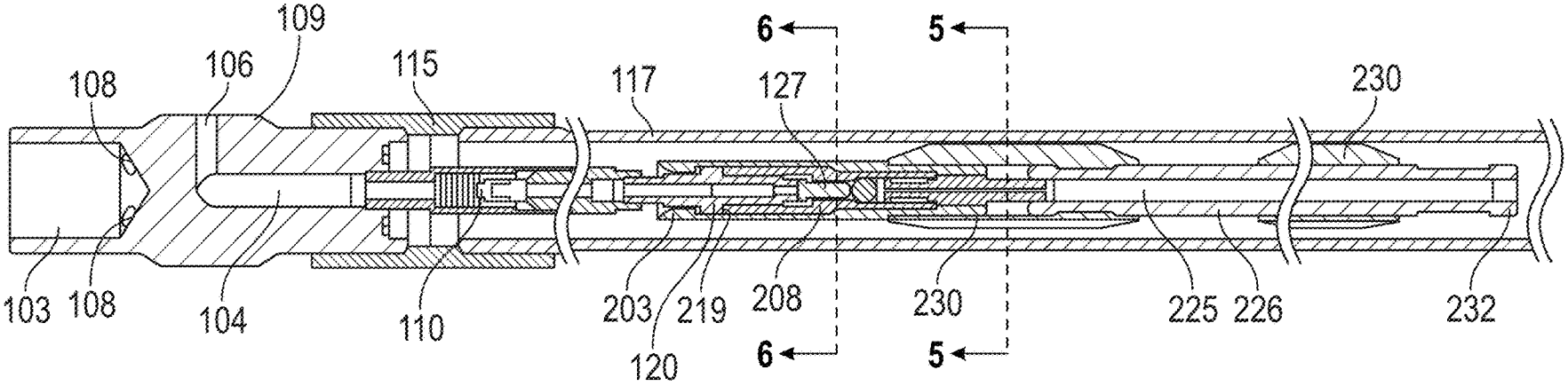
FIG. 4 is a sectional view illustrating both a dynamic valve assembly and a stationary valve assembly mounted in a production tube.
Figure 5:
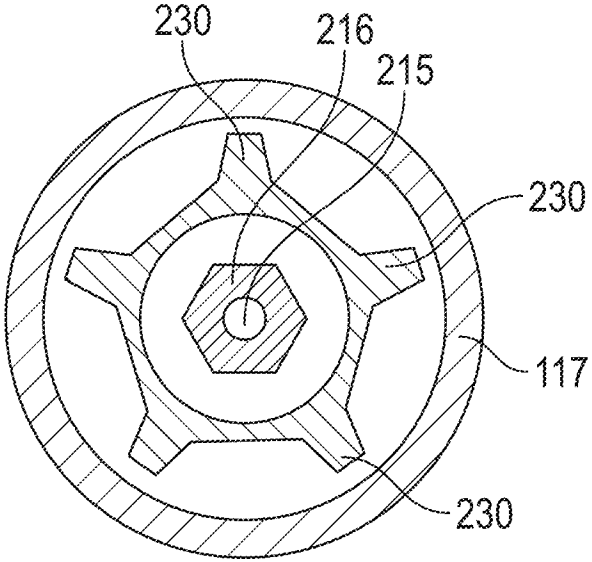
FIG. 5 is a sectional view of a portion of a dynamic valve assembly taken along section line 5-5 in FIG. 4.

FIG. 4 provides a cross-sectional view of a dynamic valve assembly 200 latched onto a stationary valve assembly 100 inside a production tube 117. FIG. 5 is a sectional view taken along section line 5-5 of FIG. 4. FIG. 5 illustrates the centralizer 230, which surrounds a portion of the dynamic valve assembly 200, keeping the dynamic valve assembly 200 essentially centered within a production tube 117. FIG. 5 also illustrates the cap 216 and the axial flow passageway 215 within the cap 216.

Figure 6:
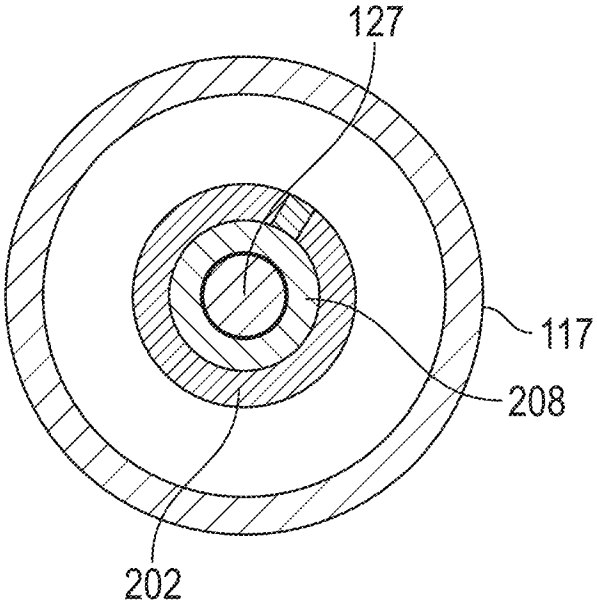
FIG. 6 is a sectional view of a portion of a dynamic valve assembly taken along section line 6-6 in FIG. 4.

FIG. 6 is a sectional taken along section line 6-6 of FIG. 4. FIG. 6 illustrates the tip 127 of the dart 120 located inside a portion of the housing 208. This view also illustrates that the collet 202 surrounds the exterior of the housing 208.

FIG. 7A-7H illustrate how the dynamic valve assembly 200 as illustrated in FIG. 2 is releasably latched onto the top of a stationary valve assembly 100 as illustrated in FIGS. 1A-1C. This would occur as the dynamic valve assembly 200 attached to the bottom of a capillary line is gradually lowered through the interior of a production tube 217. The actual latching operation requires a certain amount of force to push the bottom of the dynamic valve assembly 200 into engagement with the top of the stationary valve assembly 100. That downward force is applied by the weight of the dynamic valve assembly 200, as well as the weight of the capillary line and the weight of any fluid in the capillary line. The weight of the weight bar 226 of the dynamic valve assembly 200 can be selectively adjusted to increase or decrease the weight of the dynamic valve assembly, thereby increasing or decreasing the force with which the dynamic valve assembly 200 is pushed into engagement with the stationary valve assembly.

Figure 7A:
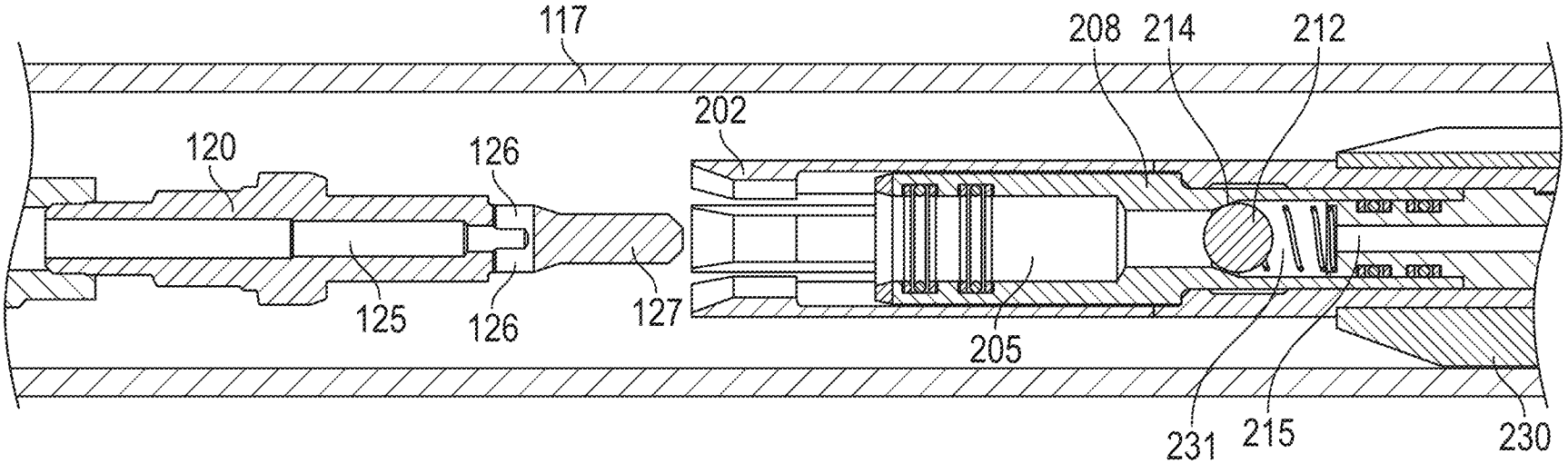
FIGS. 7A-7H are sectional views that illustrate how a dynamic valve assembly latches to a stationary valve assembly within a production tube.
Figure 7B:
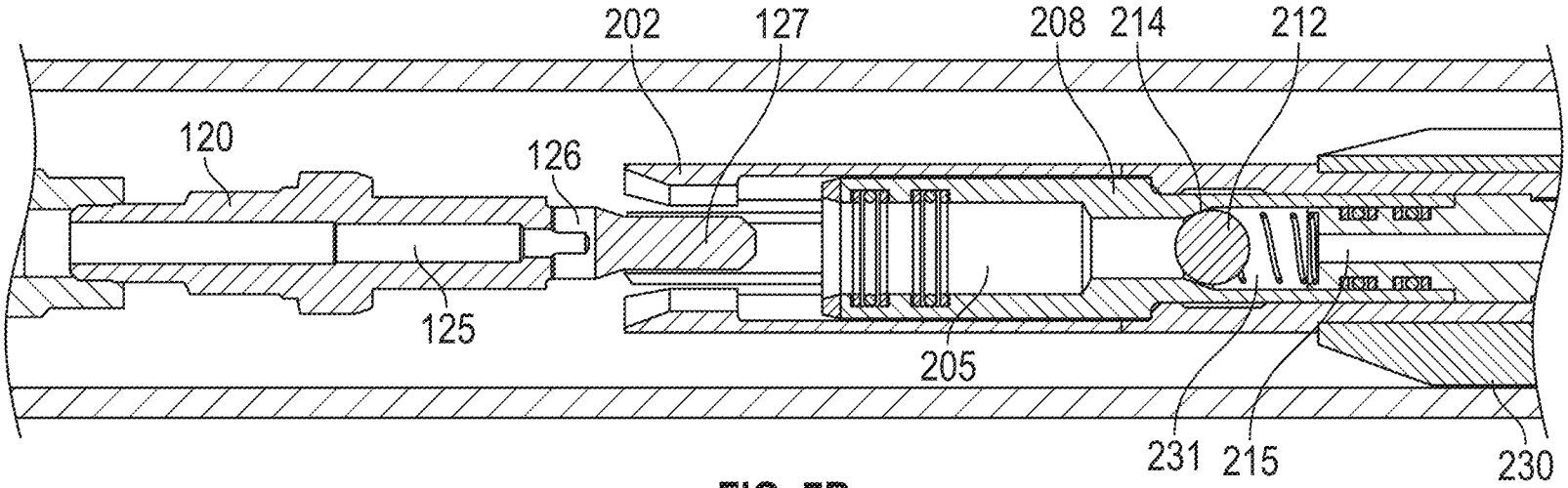

As the dynamic valve assembly 200 and capillary line are lowered down the production tube 117, the bottom of the dynamic valve assembly 200 approaches the dart 120 at the top of the stationary valve assembly 100, as illustrated in FIG. 7A. As the dynamic valve assembly 200 and the capillary line are lowered further down the production tube 117, the tip 127 of the dart 120 enters into the interior space formed by the prongs 203 of the collet 202, as illustrated in FIG. 7B. As depicted in FIG. 2, the inner surface of each of the prongs 203 of the collet 202 include leading the sloped surfaces 204, inwardly projecting pads 201 and trailing sloped surfaces 206. To the extent the collet 202 is not positioned in the exact center of the production tube 117, the leading sloped surfaces 204 of the prongs 203 of the collet 202 help to center the collet 202 around the tip 127 of the dart 120.

Figure 7C:
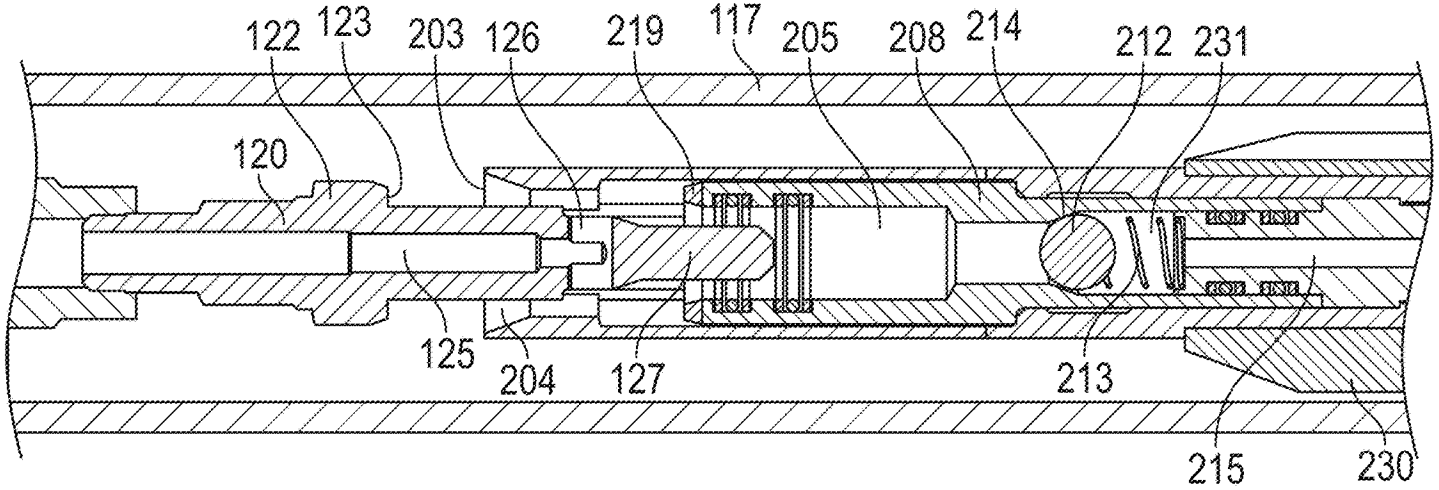

FIG. 7C illustrates the dynamic valve assembly lowered even further onto the dart 120. As shown in FIG. 7C, the tip 127 of the dart 120 has now entered into the interior space of the housing 208 of the dynamic valve assembly and is located inside the forward seals 210 provided on the interior surface of the housing 208.

Figure 7D:
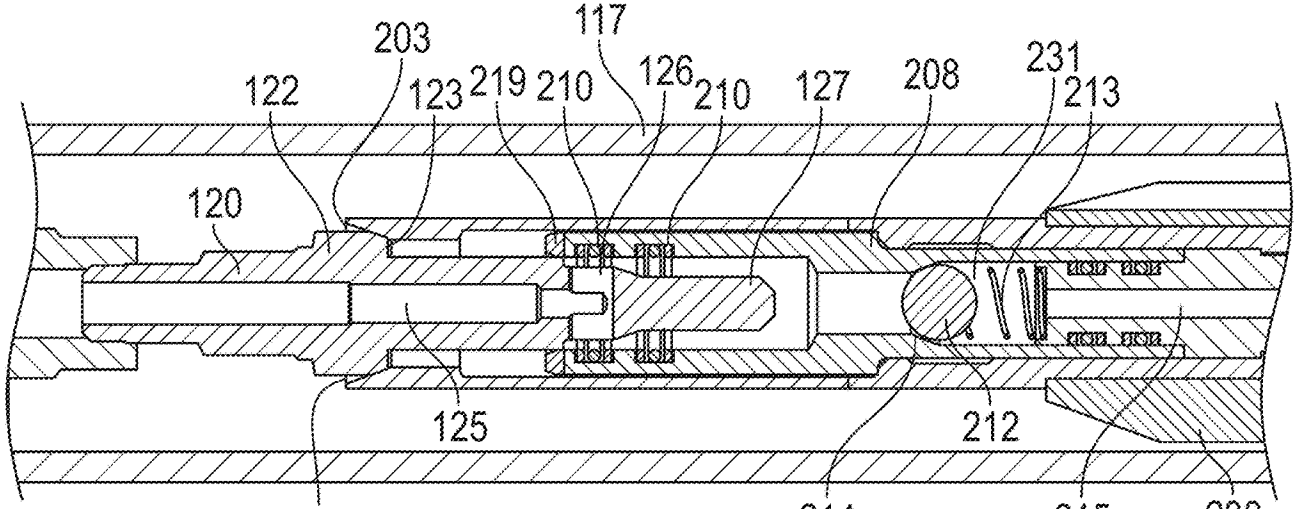

FIG. 7D illustrates the dynamic valve assembly lowered even further onto the dart 120. At this point, the leading sloped surfaces 204 of the prongs 203 of the collet 202 have engaged the leading shoulder 123 of the annular ridge 122 of the dart 120, which helps to further centralize the dynamic valve assembly with respect to the stationary valve assembly.

Further downward motion of the dynamic valve assembly will cause the sloped surfaces 204 of the prongs 203 of the collet 202 to spread the prongs outward. The material of the collet 202 as well as the length, width and thickness of the prongs 203 of the collet 202 can be selectively adjusted to adjust the amount of force that is required to cause the prongs 203 to flex outward. In addition, one can adjust the slope angle of the leading sloped surfaces 204 so that different amounts of force are required to cause the prongs 203 to flex outward during engagement and latching.

Figure 7E:
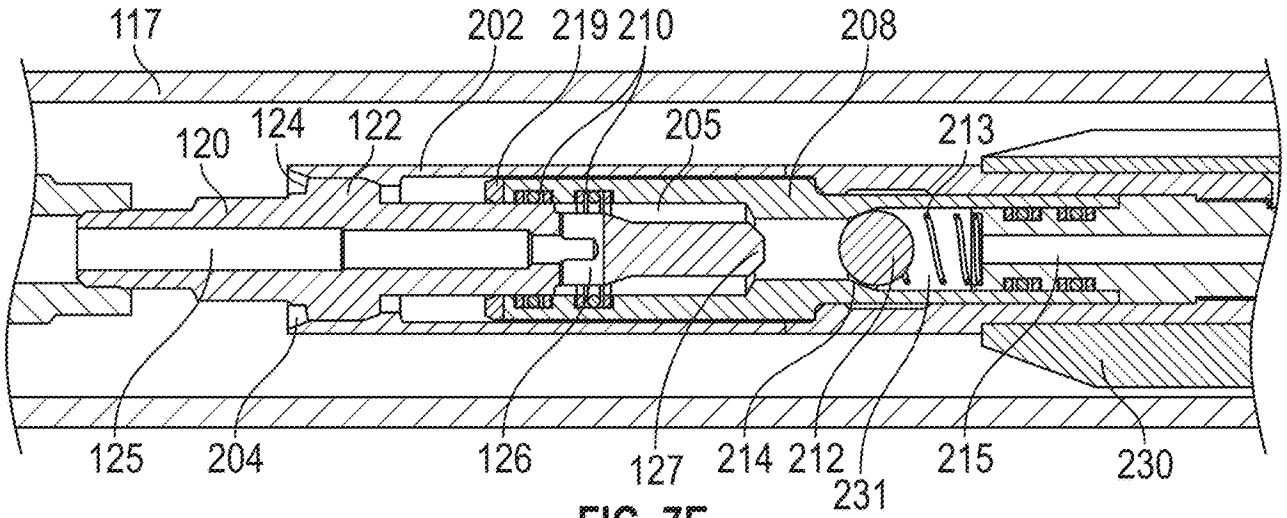

FIG. 7E illustrates the dynamic valve assembly lowered even further onto the dart 120. As illustrated in FIG. 7E, the prongs 203 of the collet have flexed outward such that pads 201 of the prongs 203 of the collet 202 are now riding along the external surface of the annular ridge 122 of the dart 120. FIG. 7E also illustrates that the exterior cylindrical surface of the dart 120 located just below the radial passageways 126 of the dart 120 have engaged the first of two seals 210 on the interior of the housing 208.

Figure 7F:
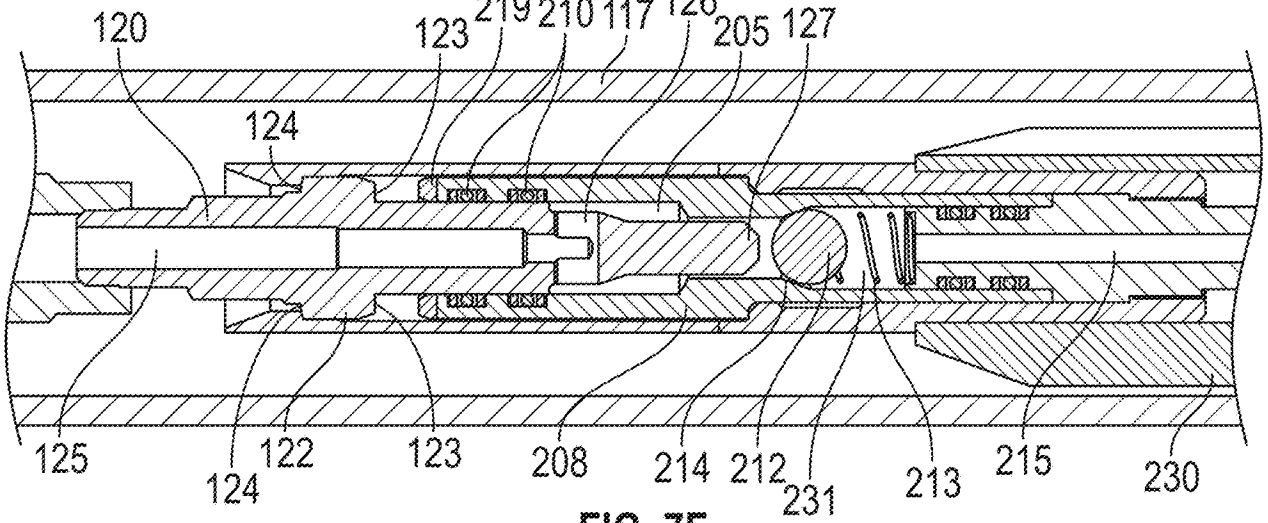

FIG. 7F illustrates the dynamic valve assembly lowered even further onto the dart 120. FIG. 7F illustrates a condition where the tip 127 of the dart is approaching the ball 122 inside the housing 208. In addition, both of the seals 210 on the interior of the housing 208 have now engaged the exterior cylindrical surface of the dart 120 below the radial fluid passageways 126. As a result, a fluid tight seal has been formed between the fluid delivery passageway 205 inside the housing 208 and the exterior of the dart 120.

Figure 7G:
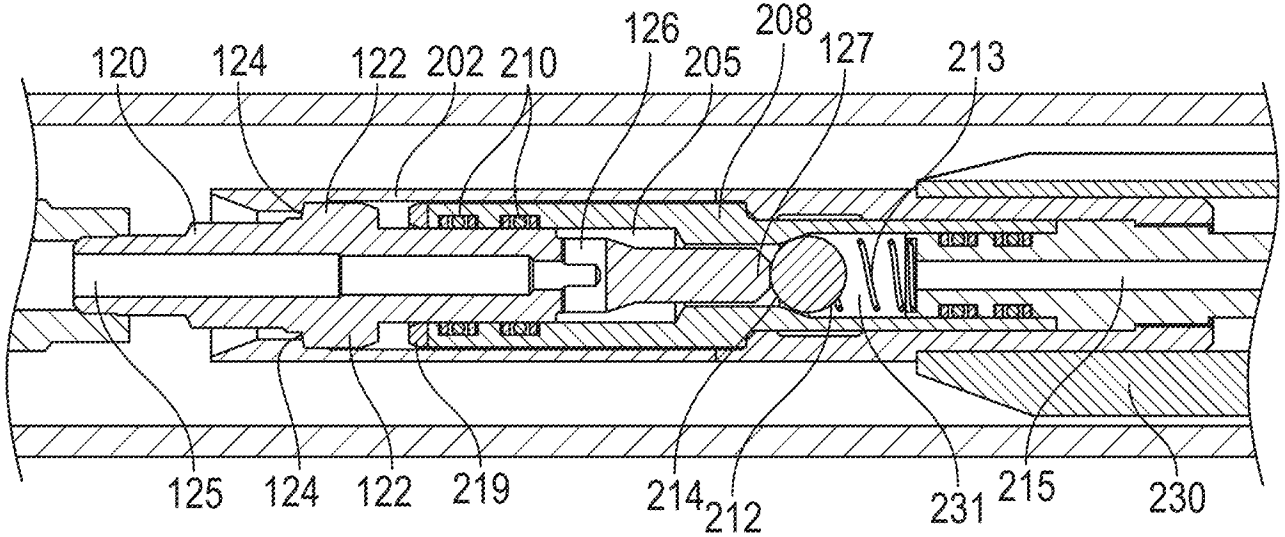
Figure 7H:
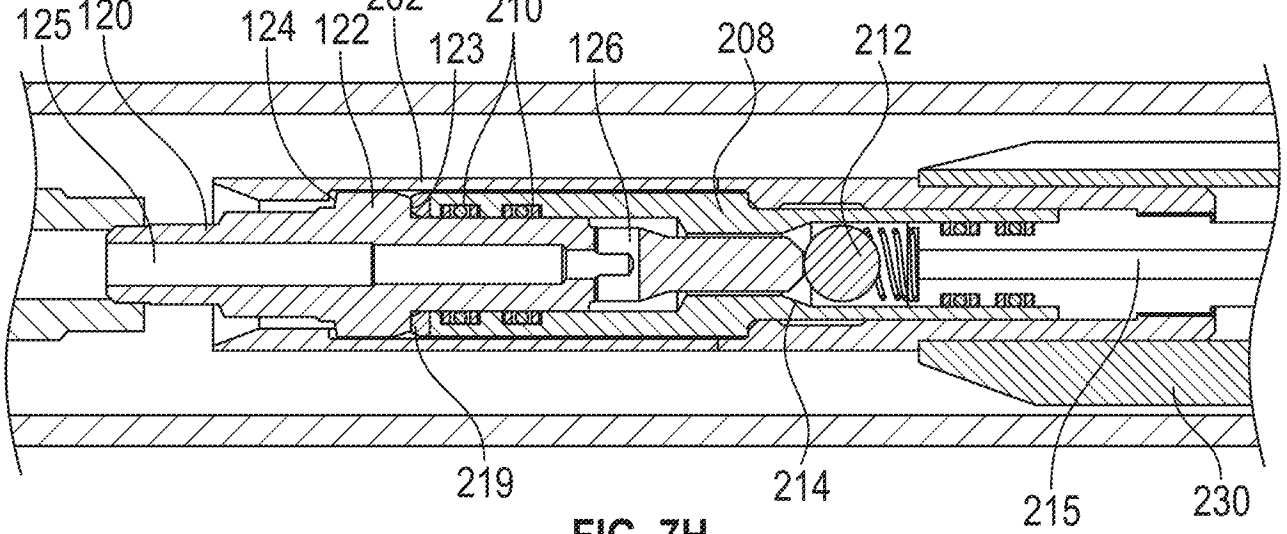

FIG. 7G illustrates the dynamic valve assembly lowered further onto the dart 120. As is apparent in FIG. 7G, the pads 201 of the prongs 203 of the collet 202 are almost past the end of the annular ridge 122 on the exterior of the dart 120. In addition, the tip 127 of the dart 120 has begun to contact the ball 212 inside the housing 208.

Further downward movement of the dynamic valve assembly causes the pads 201 of the prongs 203 of the collet 202 to move past the trailing shoulder 124 of the annular ridge 122 on the dart 120. At this point, the prongs 203 of the collet 202 contract inward and trailing sloped surfaces 206 at the upper end of the pads 201 of the prongs 203 bear against the trailing shoulder 124 of the annular ridge 122 of the dart 120 to keep the dynamic valve assembly latched onto the dart 120. In addition, the tip 127 of the dart 120 has pushed the ball 212 out of engagement with the valve seat 214 of the housing 208. This slightly compresses the spring 213 which tends to bias the ball 122 into engagement with the valve seat 214.

With the ball 212 moved away from the seat 214, fluid from the capillary line is free to flow down through the interior flow passageway 215 of the cap 216 into the fluid receiving passageway 231 of the housing 208. The fluid can then flow around the ball 212 past the valve seat 214 and past the tip 127 of the dart 122. Note, the diameter of the tip of the dart 122 is smaller than the interior diameter of the associated part of the housing 208, so that fluid can flow through the annular space located between the exterior of the tip 127 of the dart 120 and the interior cylindrical passageway of the housing 208.

The fluid flows along the fluid delivery channel 205 of the housing 208, and then through the radial fluid passageways 126 of the dart 120 into the axial fluid passageway 125 of the dart 120. The fluid can then flow down through the axial fluid passageway 125 of the dart to the injection valve 110 of the stationary valve assembly 100. The fluid can then be delivered from the injection valve 110 into the flow passageway 104 of the associated seating nipple. The fluid can then pass along the the radial passageway 106 of the seating nipple to an area in the wellbore which is at the exterior of the production tube 117.

When one wishes to disconnect the dynamic valve assembly 200 from the stationary valve assembly 100, it is possible to simply draw the capillary line and the attached dynamic valve assembly 200 back up to the top of the wellbore. The amount of force required to unlatch the dynamic valve assembly 200 from the dart 120 of the stationary valve assembly 100 will depend on the flexibility of the prongs 203 on the collet 202 of the dynamic valve assembly, as well as the slope angle of the trailing sloped surfaces 206 of the pads 201 of the prongs 203. One can adjust all these factors to selectively vary the amount of force required to unlatch the dynamic valve assembly 200 from the stationary valve assembly 100.

When the dynamic valve assembly 200 unlatches from the stationary valve assembly 100, the tip 127 of the dart 120 will back away from the ball 212 in the interior of the housing 208 of the dynamic valve assembly 200. The spring 213 will then push the ball 212 back into engagement with the valve seat 214, thereby sealing off the fluid flow from the capillary line. This helps to prevent any fluid from the interior of the production tube 117 from entering the capillary line.

In the embodiments described above, the stationary valve assembly includes a seating nipple 109, an injection valve 110, and the dart 120. All of these elements are permanently mounted to the bottom of the production tube 117. In alternate embodiments some of these elements could be releasably mounted to the bottom of the production tube 117. Also, in alternate embodiments, some of these elements could be moved to the dynamic valve assembly.

Figure 8:
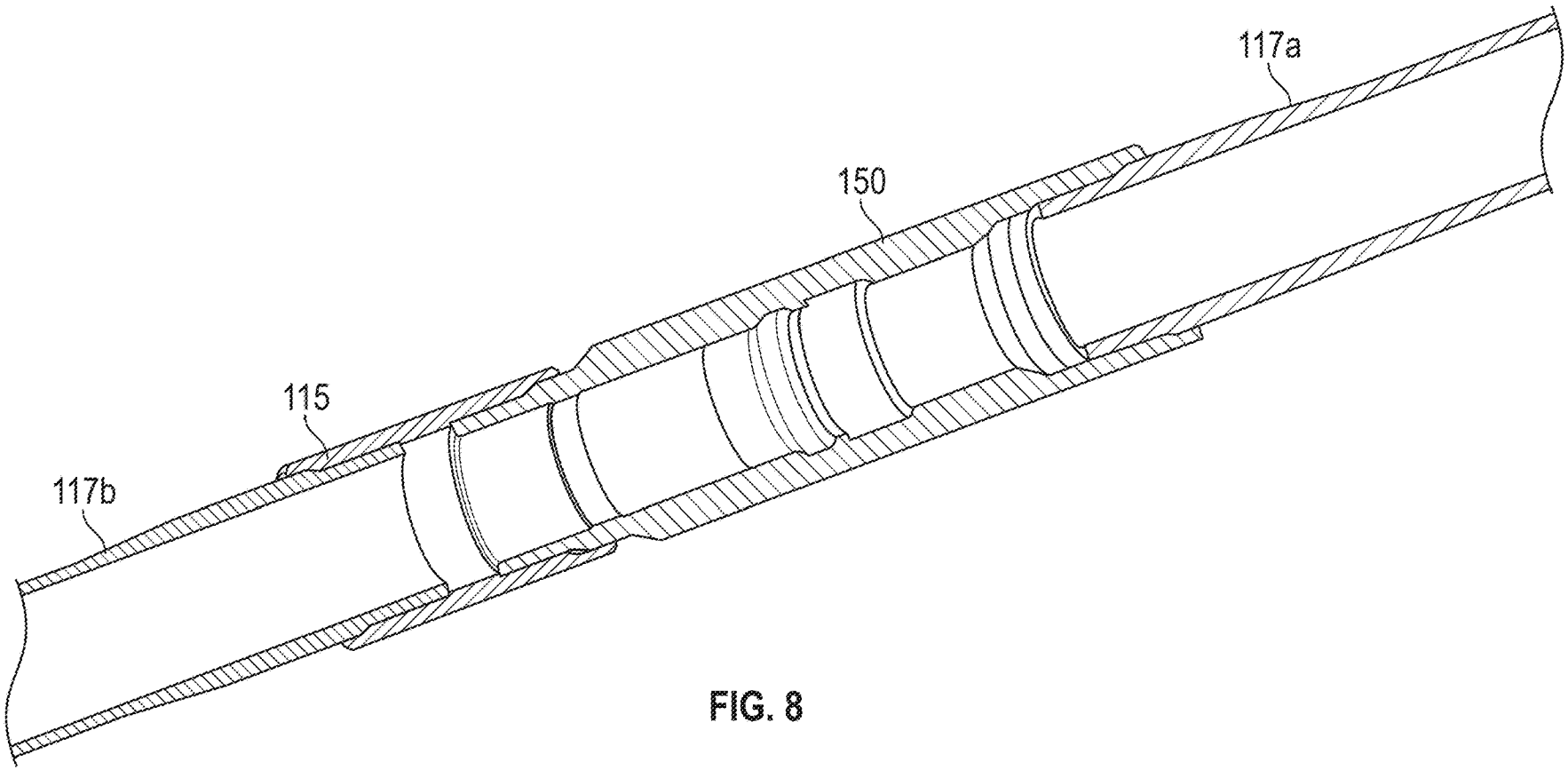
FIG. 8 is a sectional view of a portion of a production tube with a special seating coupler installed therein.

FIG. 8 illustrates a seating coupler 150 that has been installed in a portion of a production tube 117*a*. As illustrated in FIG. 8, a seating coupler 150 is mounted to a first portion of the production tube 117*a*, and the lower end of the seating coupler 150 is attached to the upper end of a collar 115. The lower end of the collar 115 is attached to a second portion of the production tube 117*b*. The seating coupler 150 is configured such that one or more components can be detachably mounted to the seating coupler 150.

The concept here is to assemble the production tube as depicted in FIG. 8. Later, when it is desirable to begin delivering a fluid or chemical into the well via a capillary line, all the components needed to deliver the fluid or chemical can be installed at the appropriate location within the production tube via wireline. If it later becomes desirable to remove all the components being used to deliver the fluid or chemical into the well, they can be retrieved via wireline.

Figure 9:
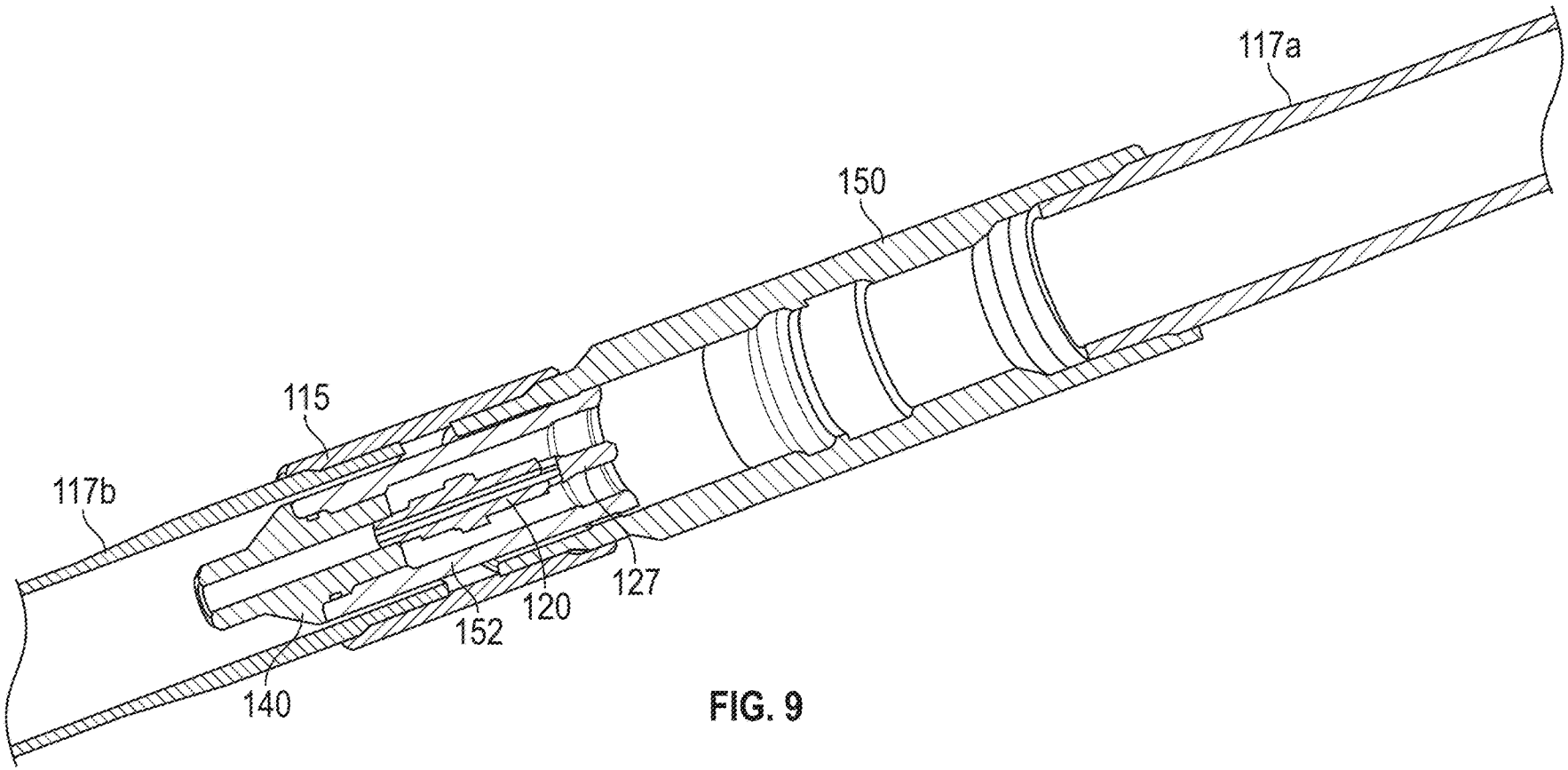
FIG. 9 is a sectional view of the portion of a production tube depicted in FIG. 8 after a dart assembly has been mounted in the seating coupler.

FIG. 9 illustrates the same section of production tubing 117*a*/117*b* as depicted in FIG. 8. However, in FIG. 9 a dart assembly has been mounted to the seating coupler 150. The dart assembly includes a cylindrical housing 152, an adaptor 140 attached to the cylindrical housing 152 and a dart 120 attached to the adaptor 140. The dart assembly would be run down upper section of the production line via wireline and then mounted to the seating coupler 150. If it later becomes desirable or necessary to remove the dart assembly, the dart assembly can be removed from the seating coupler via wireline.

Figure 10:
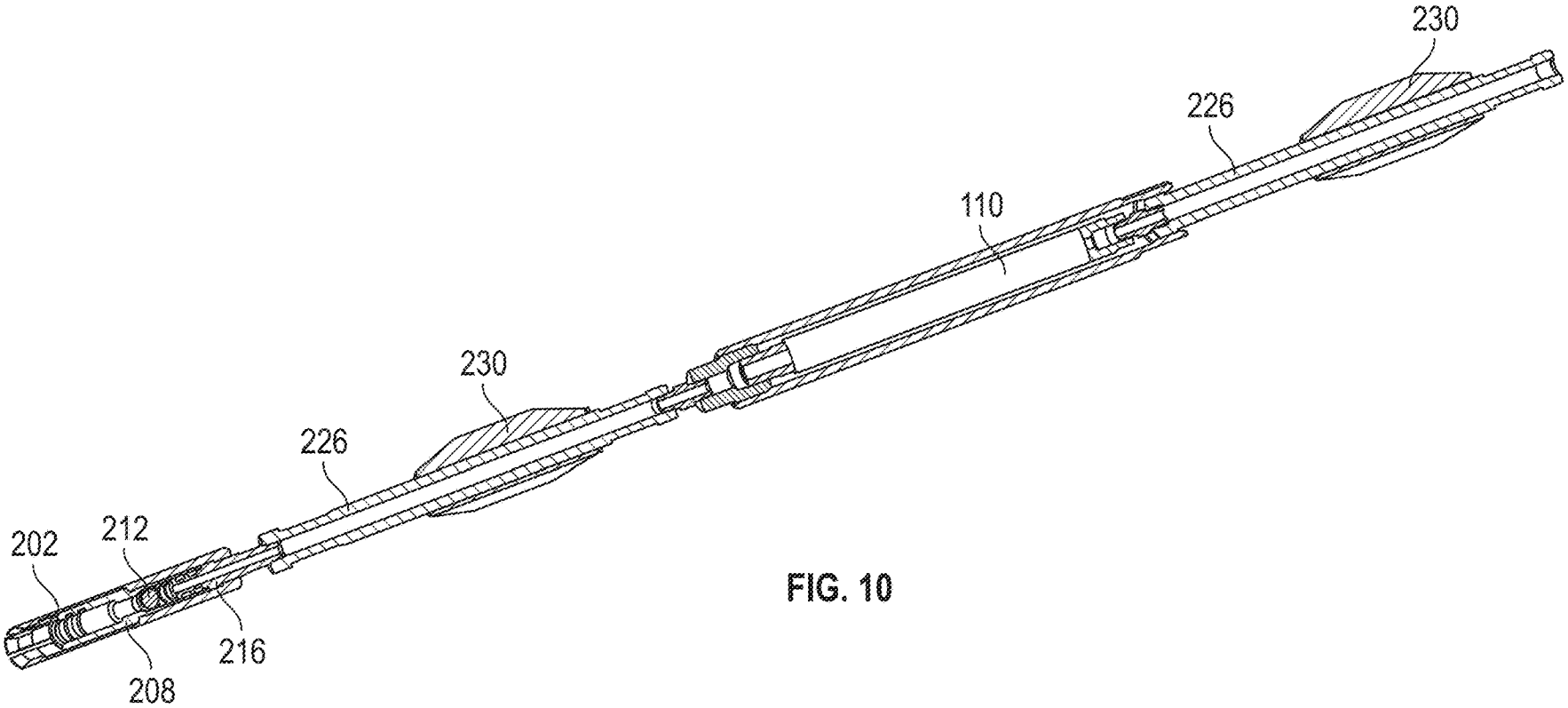
FIG. 10 is a sectional view of a dynamic valve assembly that is configured to couple to a stationary valve assembly mounted to the bottom portion of a production tube.

FIG. 10 illustrates a dynamic valve assembly that could be latched onto the dart assembly depicted in FIG. 9 after the dart assembly has itself been releasably mounted on the seating coupler 150. As shown in FIG. 10, an injection valve 110 is mounted between two weight bars 226, which are themselves mounted inside centralizers 230. The latching and unlatching mechanisms remain unchanged. Also, the function of the injection valve 110 in controlling the delivery of fluid into the well from the capillary line and preventing fluid flow back up into the capillary line remains unchanged. The only difference is that the injection valve 110 has been moved to be a part of the dynamic valve assembly.

Figure 11:
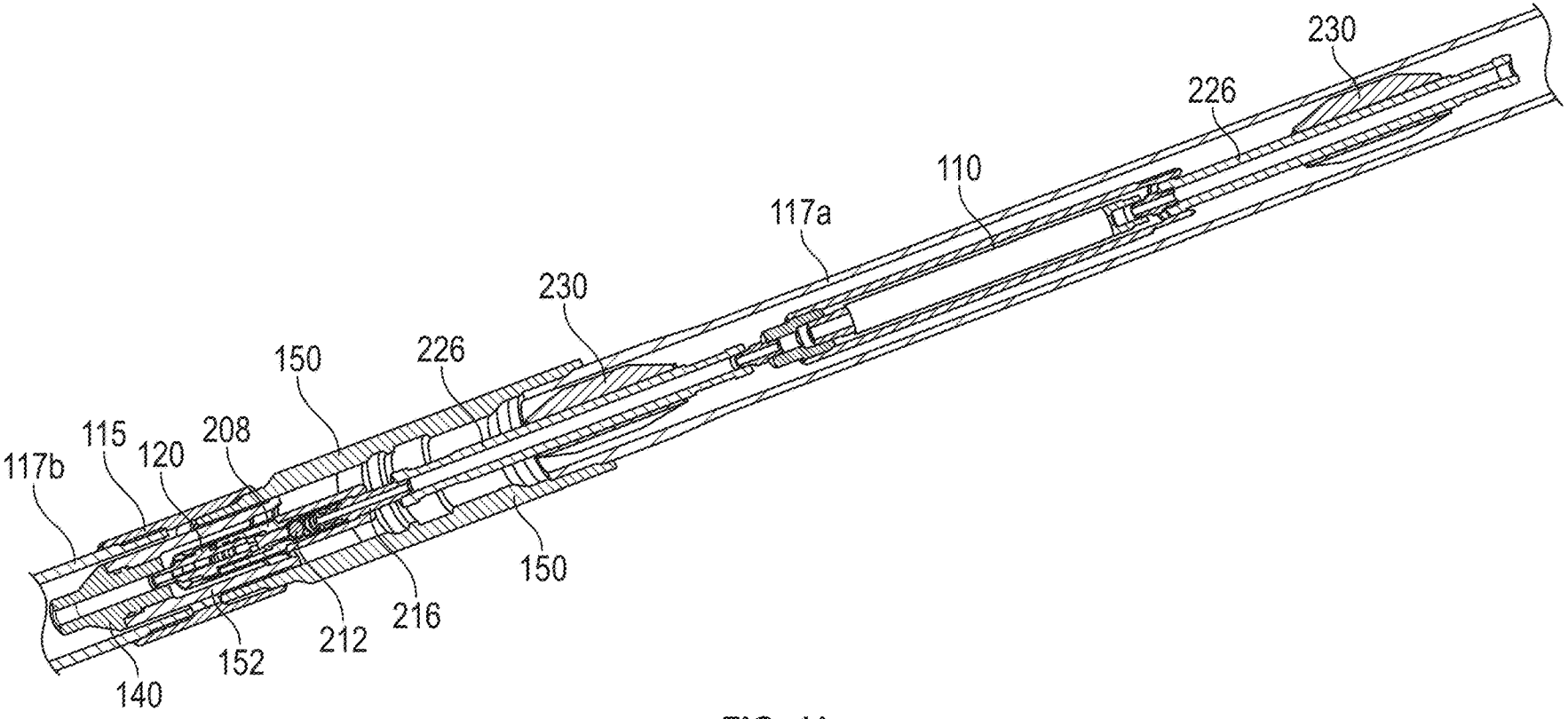
FIG. 11 is a sectional view illustrating the dynamic valve assembly depicted in FIG. 10 coupled to a dart assembly that has been mounted in the seating coupler as depicted in FIG. 9.

FIG. 11 depicts the dynamic valve assembly as illustrated in FIG. 10 mounted to the dart assembly that is itself attached to the seating coupler 150. As described above, the dynamic valve assembly could be lowered into engagement with the dart 120 to operatively couple a capillary line to the dart 120, as depicted in FIG. 11. The process of latching the dynamic valve assembly depicted in FIG. 10 to the dart assembly would proceed substantially the same as described above in connection with FIGS. 7A-7H.

Figure 12:
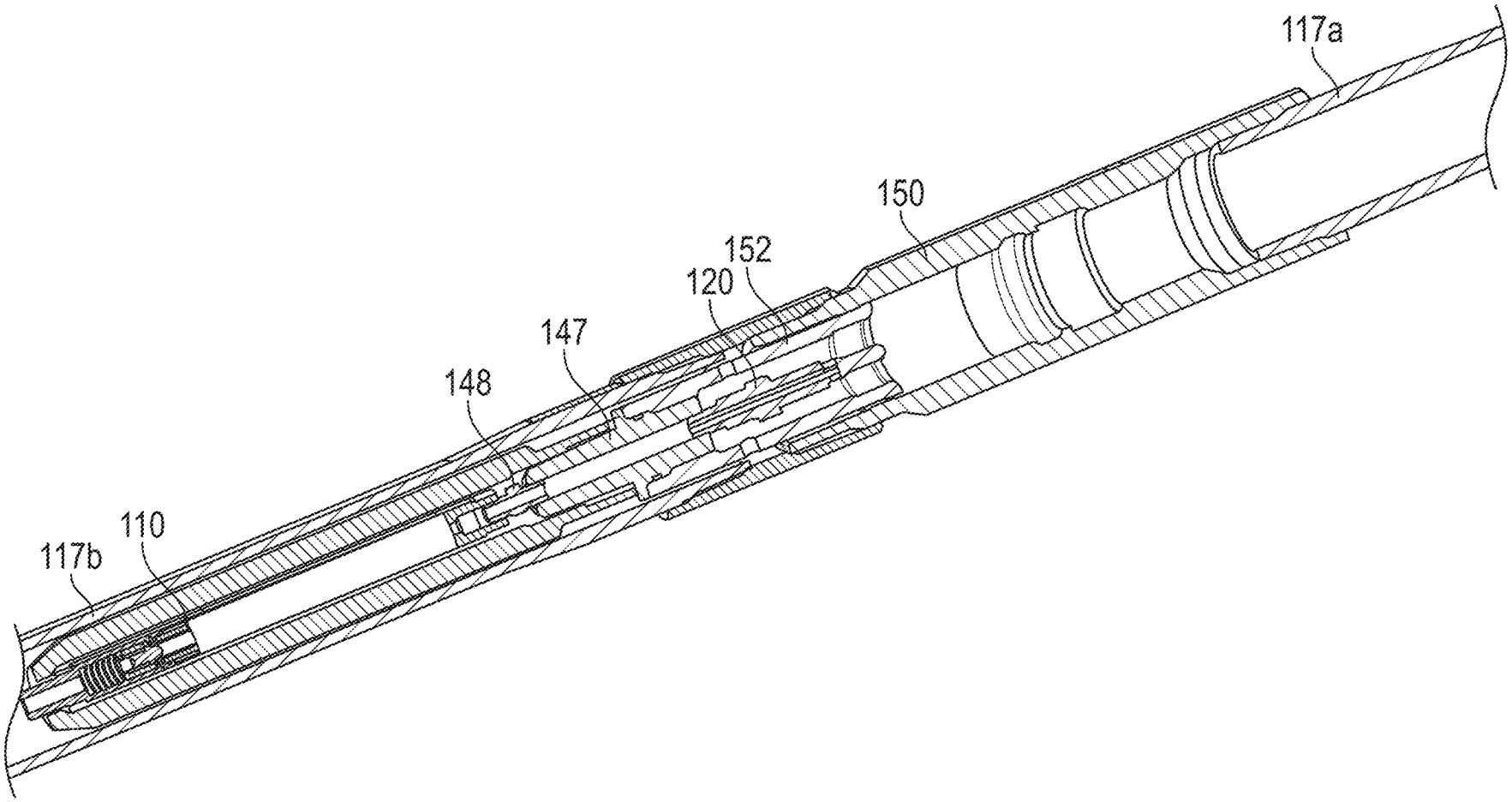
FIG. 12 is a sectional view illustrating another embodiment where elements to include a dart assembly and an injection valve have been mounted in a seating coupler installed in a section of a production tube.

In another alternate embodiment, the elements that are mounted to the seating coupler could include both the dart assembly and an injection valve 110, as depicted in FIG. 12. In this embodiment, a connector 147 that is attached to both the dart 120 and the injection valve 110 is mounted to the a cylindrical housing 152. The cylindrical housing is then mounted to the seating coupler via wireline. Here again, it if becomes desirable or necessary, one would remove that entire assembly via wireline.

The dart and injection valve assembly depicted in FIG. 12 could be used in connection with a dynamic valve assembly 200 like the one depicted above in FIG. 2. The dynamic valve assembly 200 would be latched onto the dart 120 in the same way described above.

The specific features of the various elements of the dynamic valve assembly and the stationary valve assembly in foregoing embodiments are only examples. One could make many modifications to those elements and achieve the same overall functionality. Thus, the descriptions provided above of specific embodiments should in no way be considered limiting.

For example, the ball 212 and seat 214 in the housing 208 of the dynamic valve assembly 200 could be replaced with a different type of actuation mechanism. For example, a dart valve having a stem and a seating surface could replace the ball 212. The stem of the dart valve could extend down into the fluid delivery passageway 205 of the housing. In this case, a stationary element of the stationary valve assembly could push the dart valve upward as the dynamic valve assembly is lowered within the production tubing to open the valve assembly and allow pressurized fluid to flow from the dynamic valve assembly into the stationary valve assembly.

As another example, in the foregoing embodiments the prongs 203 of a collet 202 latch to an outwardly protruding annular ridge 122 of the dart 120 to latch the dynamic valve assembly to the stationary valve assembly. In alternate embodiments a different sort of latching arrangement could be provided. Those of skill in this art are aware of multiple different ways of releasably latching a first tool element to a second tool element within a wellbore, and any such alternate latching arrangement could be used.

Figure 13:
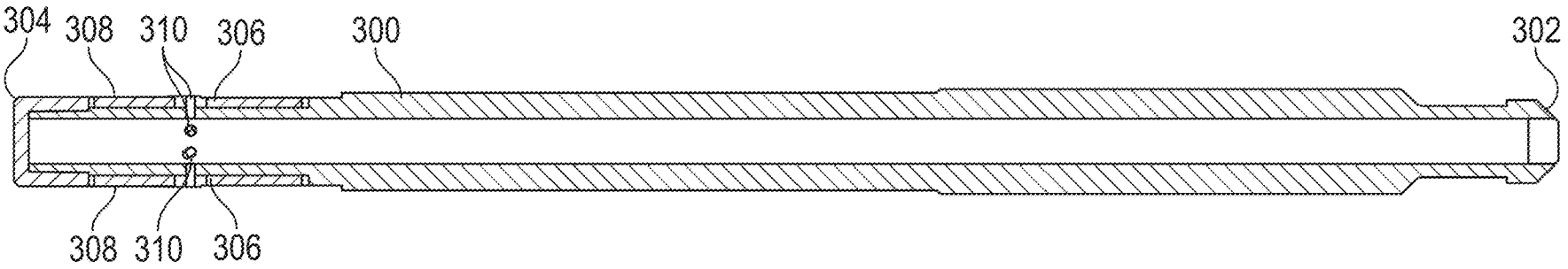
FIG. 13 is a sectional view of a spear that comprises part of an assembly for delivering a fluid into a well.

FIG. 13 is a sectional view illustrating a portion of an alternate embodiment of a dynamic valve assembly that can be used to deliver pressurized fluid into a well. FIG. 13 illustrates a spear 300 that would be connected to the end of a capillary line which is run down into a well bore to deliver a fluid from the capillary line into a portion of the well bore. The spear 300 includes a first end 304 and a second end 302. The second end 302 would be attached to the capillary line used to deliver fluid into the well bore.

The spear 300 includes a cylindrical hollow body with a plurality of radially extending fluid supply passageways 310 located adjacent to the first end 304 of the spear 300. The radial fluid supply passageways 310 would emit the fluid delivered through the capillary line to the interior of the hollow body of the spear 300.

A first cylindrical sealing member 306 is provided on the outer cylindrical surface of the spear 300 on a first side of the fluid supply passageways 310. A second cylindrical sealing member 308 is provided on the outer cylindrical surface of the spear 300 on the other side of the fluid supply passageways 310. The first and second cylindrical sealing members 306, 308 are configured to form a seal with a flow plug as described in greater detail below.

Figure 14:
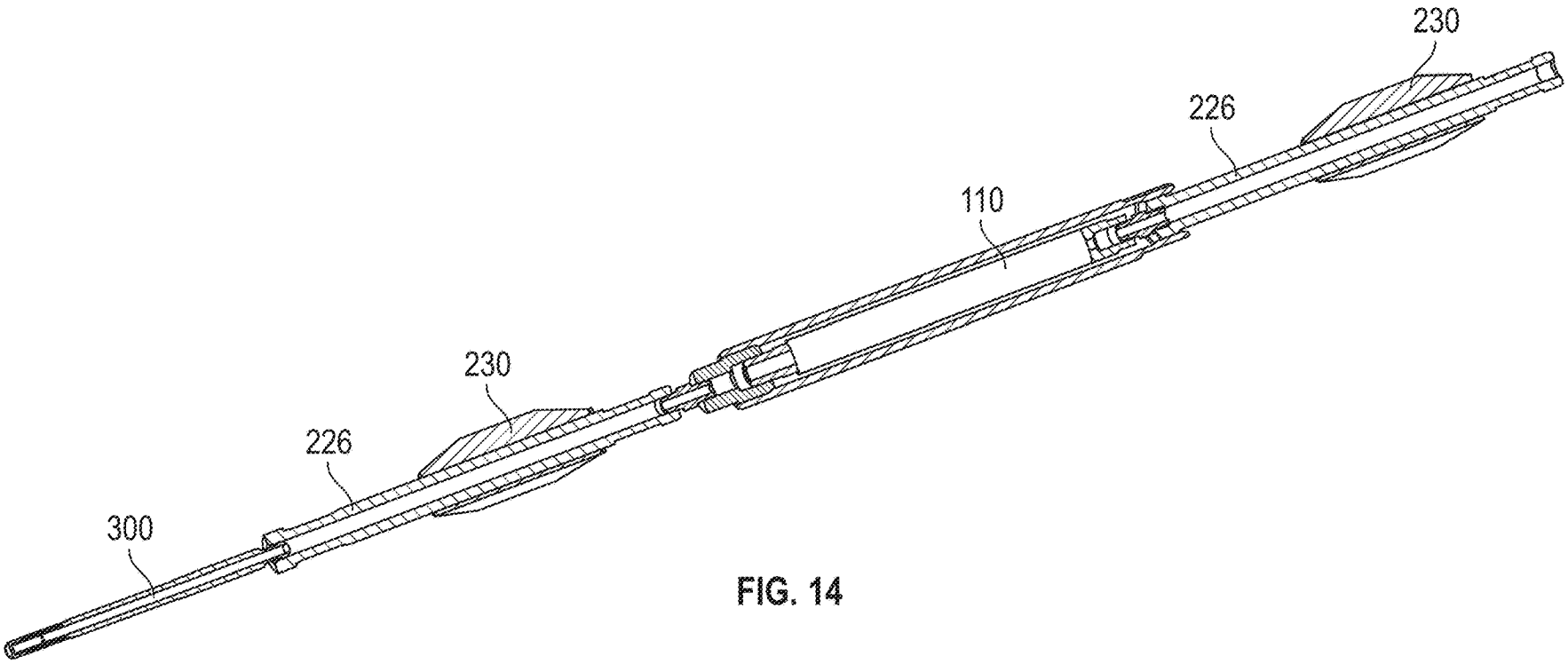
FIG. 14 is a sectional view of a dynamic assembly that includes the spear depicted in FIG. 13.

FIG. 14 illustrates the spear 300 connected to the end of a dynamic valve assembly that would be attached to a capillary fluid supply line. The assembly includes an injection valve 110 mounted between two weight bars 226, which are themselves mounted inside centralizers 230. The spear 300 as depicted in FIG. 13 is then attached to the lower end of the second weight bar 226.

Figure 15A:
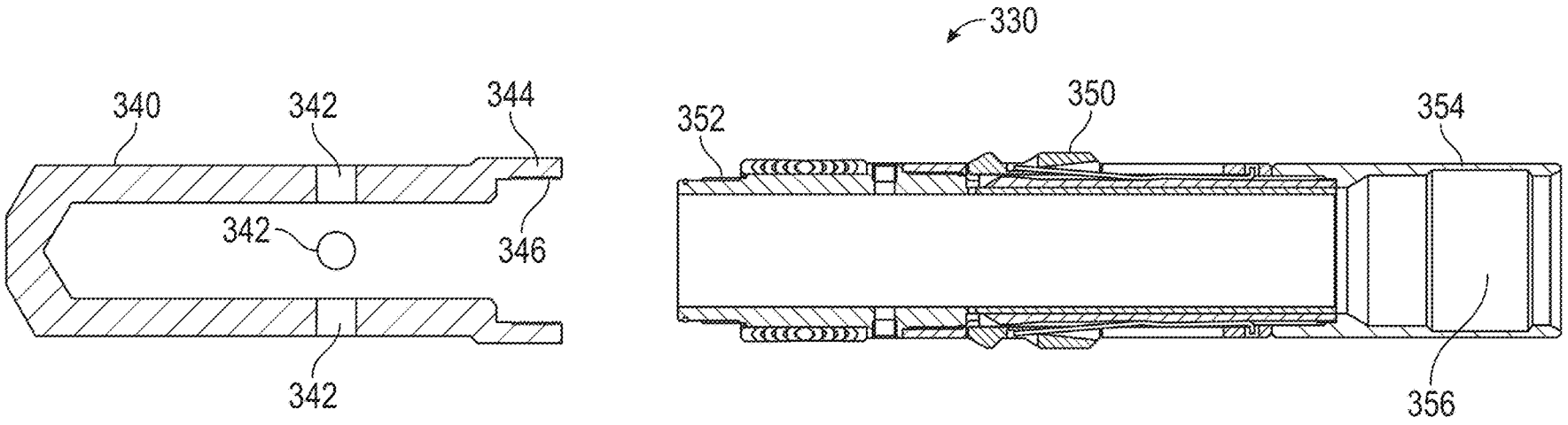
FIG. 15A is a sectional view of a flow plug assembly that can be part of an assembly for delivering a fluid into a well.
Figure 15B:
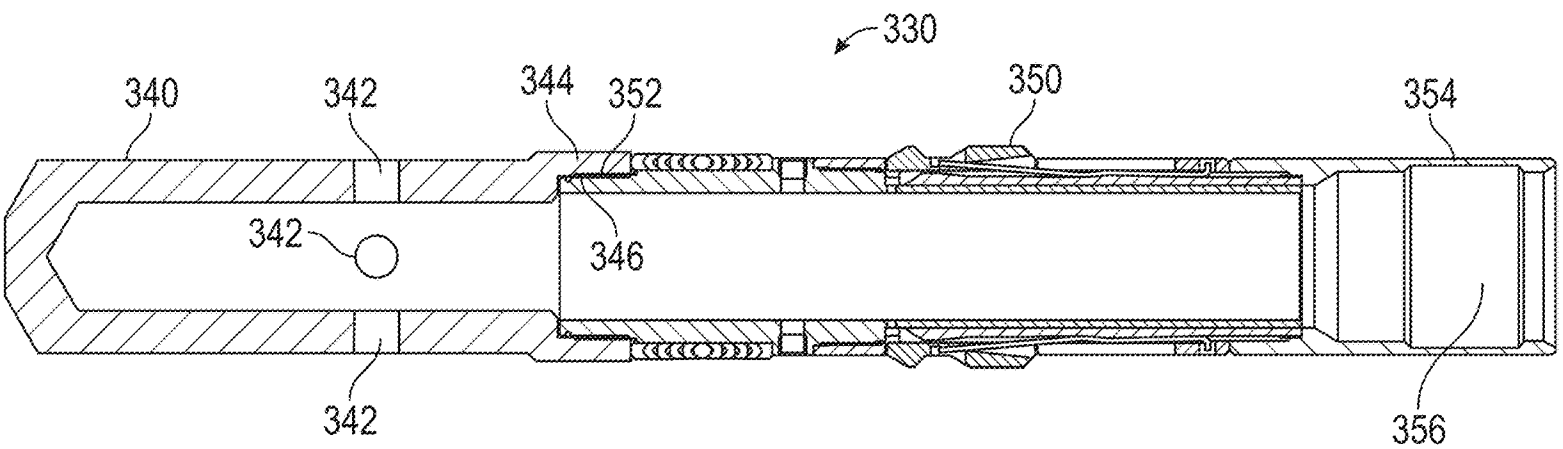
FIG. 15B is a sectional view of the flow plug assembly illustrated in FIG. 15A in an assembled condition.

FIGS. 15A and 15B illustrate parts of a flow plug assembly 330 which would be mounted at a particular location within the wellbore. Typically the flow plug assembly 330 would be mounted to a production tube within the wellbore at a location where fluid from a capillary supply line is to be delivered into the well.

The flow plug assembly 330 includes a hollow cylindrical body 340 which is attached to an x-lock assembly 350. Internal threads 346 on a coupling portion 344 at a second end of the hollow cylindrical body 340 are screwed onto external threads 352 on the x-lock assembly 350. FIG. 15A shows the two parts prior to assembly and FIG. 15B shows the two parts once they have been assembled together at the coupling 344. The hollow cylindrical body 340 of the flow plug assembly 330 includes a plurality of radially extending flow passageways 342. The x-lock assembly 350 also includes a fishing neck 354 at a second end 356. The flow plug assembly 330 depicted in FIGS. 15A and 15B is designed to receive a spear as depicted in FIG. 13.

Alternate embodiments could include similar types of downhole positioning tools. Thus, the use of an x-lock assembly in this embodiment should in no way be considered limiting of the way in which a flow plug assembly could be created. Alternate embodiments could include a different type of positioning tool. Or, no positioning tool elements whatsoever.

Figure 16:
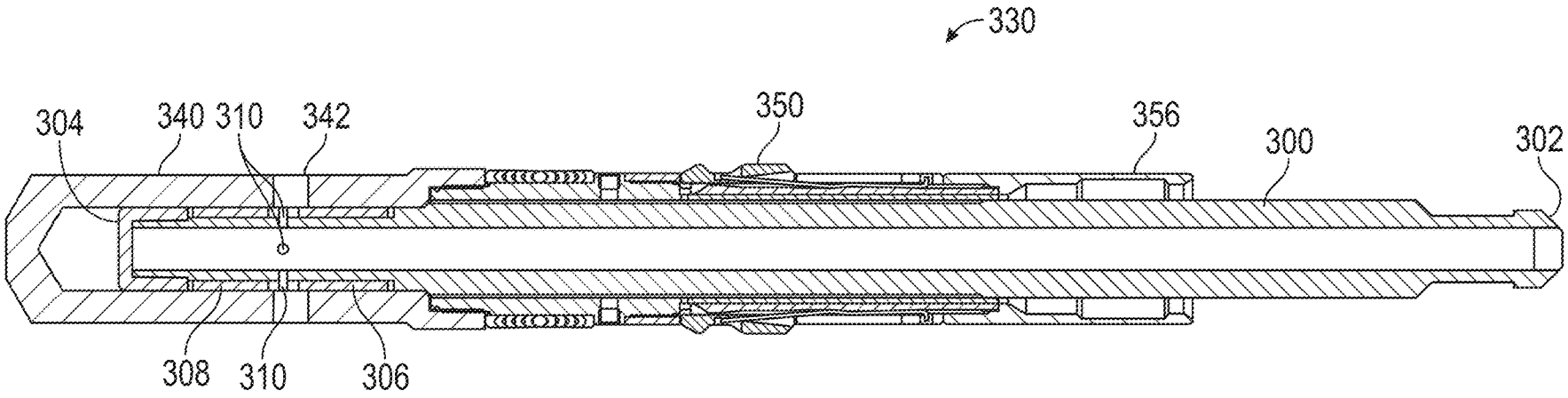
FIG. 16 is a sectional view of a flow plug assembly and a spear, which together form part of an assembly for delivering a fluid into a well.

FIG. 16 illustrates the combination of the spear 300 depicted in FIG. 13 and the flow plug assembly 330 depicted in FIGS. 15A and 15B. As shown in FIG. 16, the first end 304 of the spear 300 is inserted into the interior of the hollow cylindrical body 340 of the flow plug assembly 330 so that the radially extending fluid supply passageways 310 of the spear 300 are aligned with the flow passageways 342 on the hollow cylindrical body 340 of the flow plug assembly 330. When the second end 302 of the spear 300 is attached to the end of a capillary fluid supply line, fluid is delivered in the interior of the spear 300. The fluid can then flow through the fluid supply passageways 310 of the spear 300 and then out the flow passageways 342 of the flow plug assembly 330 to deliver the fluid from the capillary supply line to the interior of the wellbore.

FIG. 16 also illustrates that the first and second sealing members 306, 308 on the external cylindrical surface of the spear 300 bear against and form a fluid tight seal with the interior cylindrical wall of the hollow cylindrical body 340 of the flow plug assembly 330. This ensures that the fluid delivered to the interior bore of the spear 300 is emitted into the wellbore, rather than just to the interior of the flow plug assembly 330.

Figure 17:
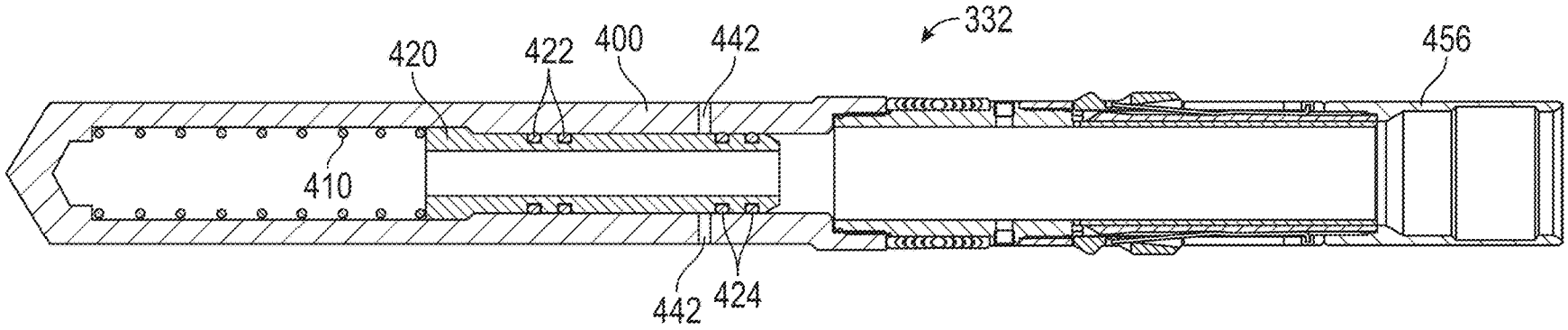
FIG. 17 is a sectional view of a flow plug assembly that includes a cylindrical shutter which forms part of an assembly for delivering a fluid into a well.

FIG. 17 is a sectional view of another embodiment of a flow plug assembly 332 which can be part of a dynamic valve assembly for delivering fluid into a well. In this embodiment, a hollow cylindrical shutter 420 is mounted in the interior of a hollow cylindrical body 400 of the flow plug assembly 332 A biasing member 410 trapped between a first end of the hollow cylindrical shutter 420 and the first end of the interior of the hollow cylindrical body 400 of the flow plug assembly 332. The biasing member 410 biases the hollow cylindrical shutter 420 into a closed position. In the closed position, the hollow cylindrical shutter 420 closes off the radially extending flow passageways 442 of the flow plug assembly 332.

A plurality of circular seals 422 and 424 are mounted around the exterior of the hollow cylindrical shutter 420. The circular seals 422, 424 form a fluid tight seal between the exterior of the hollow cylindrical shutter 420 and the interior cylindrical surface of the hollow cylindrical body 400 of the flow plug assembly 332. In alternate embodiments, different types of sealing elements could be used.

When the hollow cylindrical shutter 420 is in the closed position, as illustrated in FIG. 17, a first set of circular seals 422 are located on a first side of the radially extending flow passageways 442 and the second set of circular seals 424 are located on the opposite side of the radially extending passageways 442. This ensures that the interior of the flow plug assembly 332 is sealed off from the radially extending flow passageways 442 such that any fluid in the interior of the flow plug assembly 332 cannot escape through the flow passageways 442, and wellbore fluid cannot ingress into the tubing section.

Figure 18A:
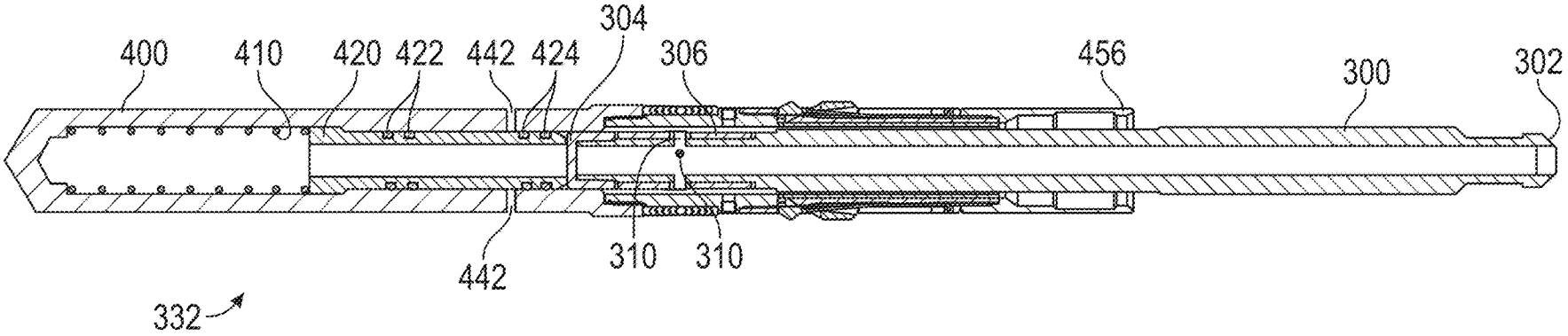
FIG. 18A is a sectional view of the combination of a spear and a flow plug as depicted in FIG. 17, where the spear is partially inserted into the flow plug.
Figure 18B:
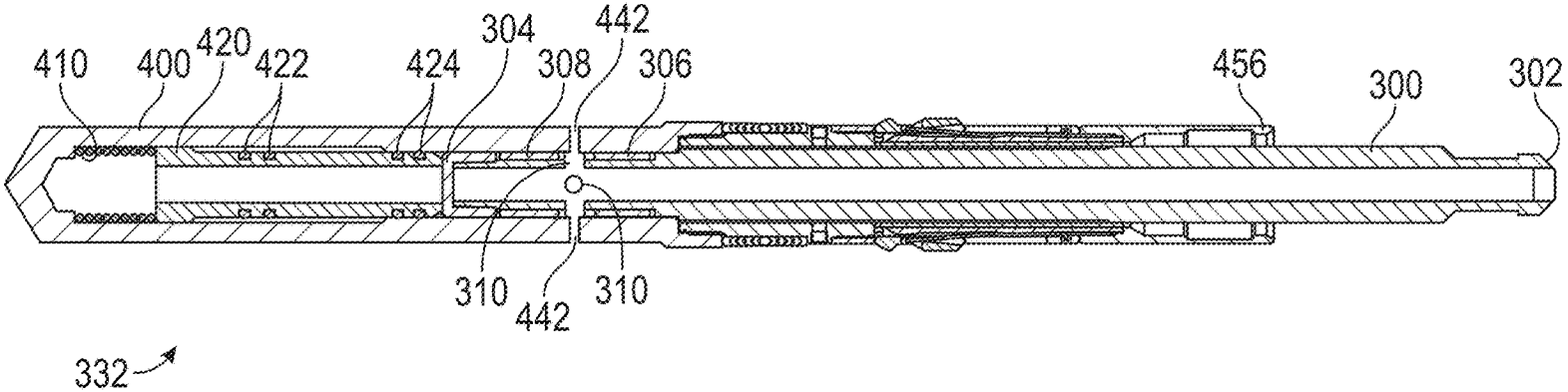
FIG. 18B is a sectional view of the flow plug and spear of FIG. 18A with the spear fully inserted into the flow plug.

FIG. 18A illustrates the flow plug assembly 332 depicted in FIG. 17 with a spear 300 partially inserted into the flow plug assembly 332. FIG. 18B shows the spear 300 full inserted into the flow plug assembly 332. As shown in FIG. 18A, as the spear 300 is inserted into the interior of the flow plug assembly 332, a first end 304 of the spear 300 abuts the second end of the hollow cylindrical shutter 420. As the spear 300 is inserted further into the flow plug assembly 332, the first end 304 of the spear 300 pushes the hollow cylindrical shutter 420 downward against the biasing action of the biasing member 410. When the spear 300 is fully inserted into the flow plug assembly 332, the radially extending fluid supply passageways 310 of the spear 300 align with the radially extending flow passageways 442 of the flow plug assembly 332 so that fluid from the interior of the spear 300 can be emitted out of the flow passageways 442 of the flow plug assembly 332 and into the wellbore. As depicted in FIG. 18B, when the spear 300 is fully inserted into the flow plug assembly 332, the first and second seal members 306, 308 on the exterior of the spear 300 are positioned on opposite sides of the radially extending flow passageways 442 of the flow plug assembly 332.

When the spear 300 is subsequently withdrawn from the flow plug assembly 332, the biasing member 410 will push the hollow cylindrical shutter 420 back into the closed position depicted in FIGS. 17 and 18A so that the hollow cylindrical shutter 420 will once again cover and close of the radially extending flow passageways 442.

Figure 19A:
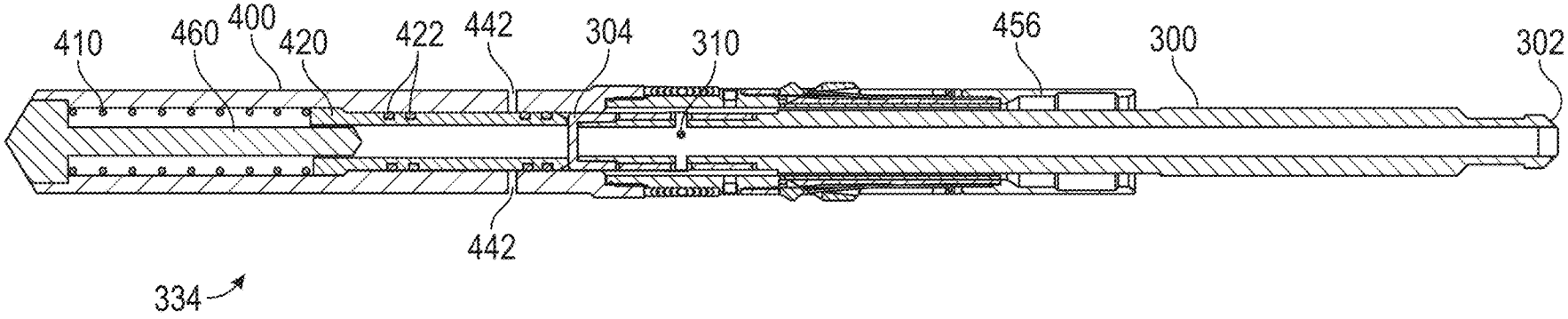
FIGS. 19A and 19B are sectional views showing the combination of a spear and a second embodiment of a flow plug, with the spear partially inserted into the flow plug in FIG. 19A and the spear fully inserted into the flow plug in FIG. 19B.
Figure 19B:
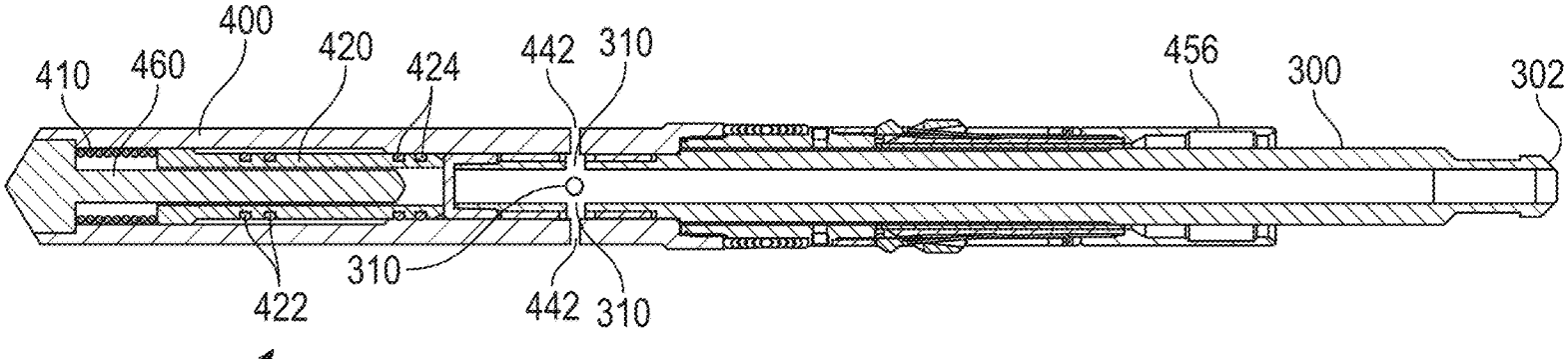

FIGS. 19A and 19B depict an alternate embodiment of the flow plug assembly 334 which includes a post 460 located in the interior of the hollow cylindrical body 400 of the flow plug assembly 334. In this embodiment, the biasing member 410 in the form of a coil spring occupies an annular space formed between the exterior of the post 460 and the interior cylindrical surface of the hollow cylindrical body 400 of the flow plug assembly 334. FIG. 19A illustrates the spear 300 after it has been partially inserted into the flow plug assembly 334. FIG. 19B illustrates the spear 300 fully inserted into the flow plug assembly 334 such that the hollow cylindrical shutter 420 has been moved into the open position. As depicted in FIGS. 19A and 19B, the hollow cylindrical shutter 420 also slides within the annular space between the exterior of the post 460 and the interior cylindrical surface of the hollow cylindrical body 400 of the flow plug assembly 334. Thus, the post helps to support and guide the movement of the hollow cylindrical shutter 420.

Figure 20:
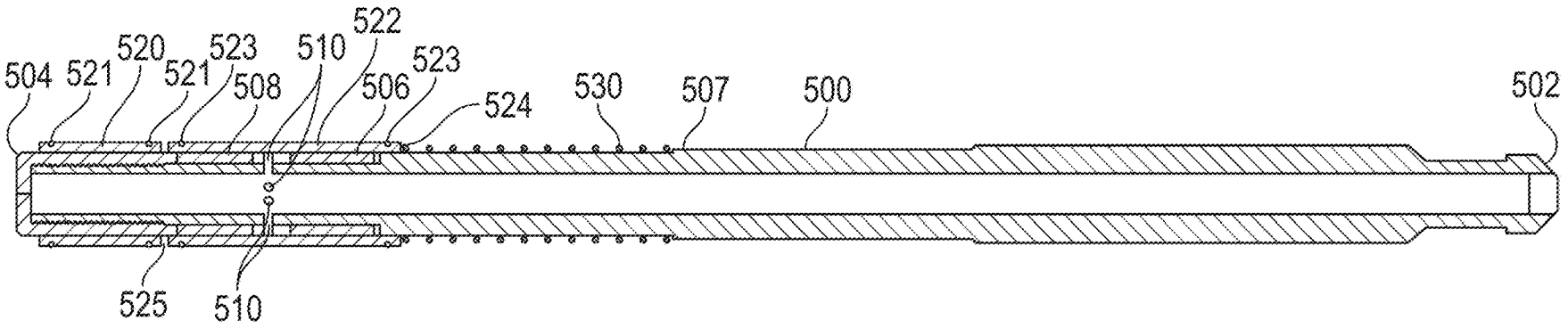
FIG. 20 is a sectional view of another embodiment of a spear which can be part of an assembly for delivering a fluid into a well.

FIG. 20 illustrates another alternate embodiment of the spear 500 which includes a hollow cylindrical shutter 520 mounted around the exterior cylindrical surface of the spear 500. In this embodiment, a biasing member in the form of a coil spring 530 is positioned between a shoulder 507 on the exterior of the spear 500 and a second end 524 of the hollow cylindrical shutter 520. The biasing member 530 biases the hollow cylindrical shutter 520 into a closed position, as depicted in FIG. 20. When the hollow cylindrical shutter 520 is in the closed position, it covers the radially extending fluid supply passageways 510.

The spear 500 in this embodiment still includes first and second sealing members 506, 508 located on opposite sides of the radially extending fluid supply passageways 510. The first and second sealing members 506, 508 provide a fluid tight seal between the exterior of the spear 500 and the interior of the hollow cylindrical shutter 520. When the hollow cylindrical shutter 520 is in the closed position, as depicted in FIG. 20, the first and second sealing members 506, 508 prevent any fluid in the interior of the spear 500 from escaping through the radially extending fluid supply passageways 510.

Figure 21:
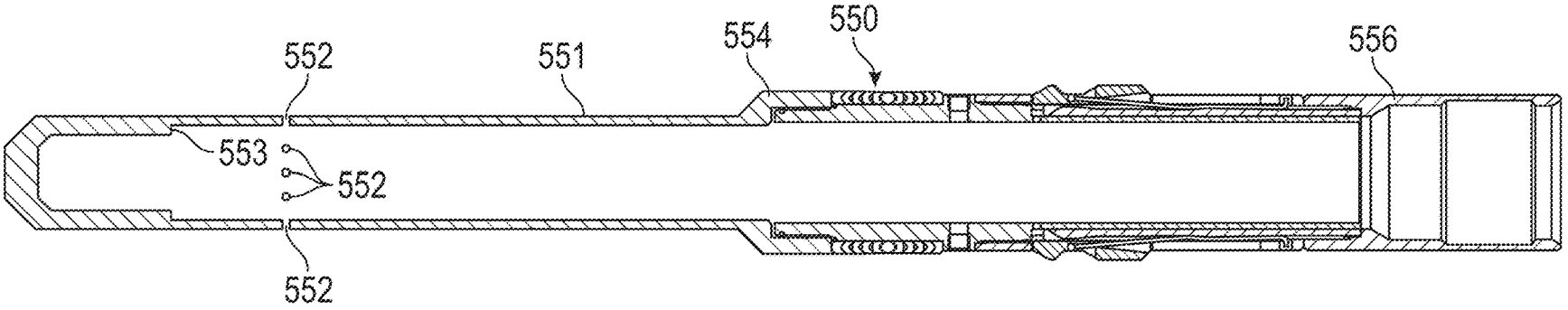
FIG. 21 is a sectional view of another embodiment of a flow plug that can be used in conjunction with the spear illustrated in FIG. 20 to form an assembly for delivering a fluid into a well.

FIG. 21 depicts a flow plug assembly 551 which could be used in conjunction with the spear depicted in FIG. 20. This embodiment of the flow plug assembly 551 includes a plurality of radially extending flow passageways 552. This embodiment of the flow plug assembly 551 also includes a shoulder 553 on the interior cylindrical surface of the flow plug assembly 551 that can be used to cause the hollow cylindrical shutter 520 on the exterior of the spear 500 to move from the closed position to an open position.

Figure 22A:
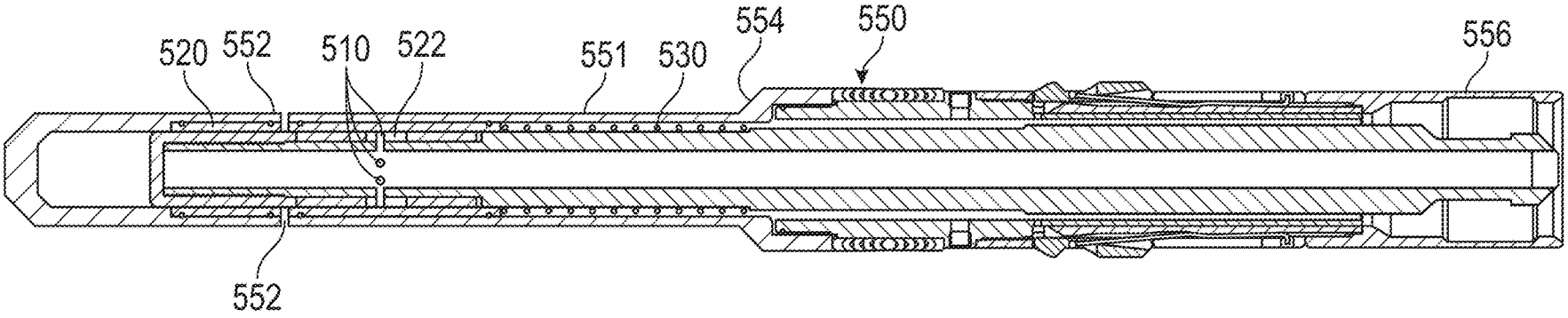
FIG. 22A shows the flow plug of FIG. 21 and the spear of FIG. 20 partially inserted into the flow plug.
Figure 22B:
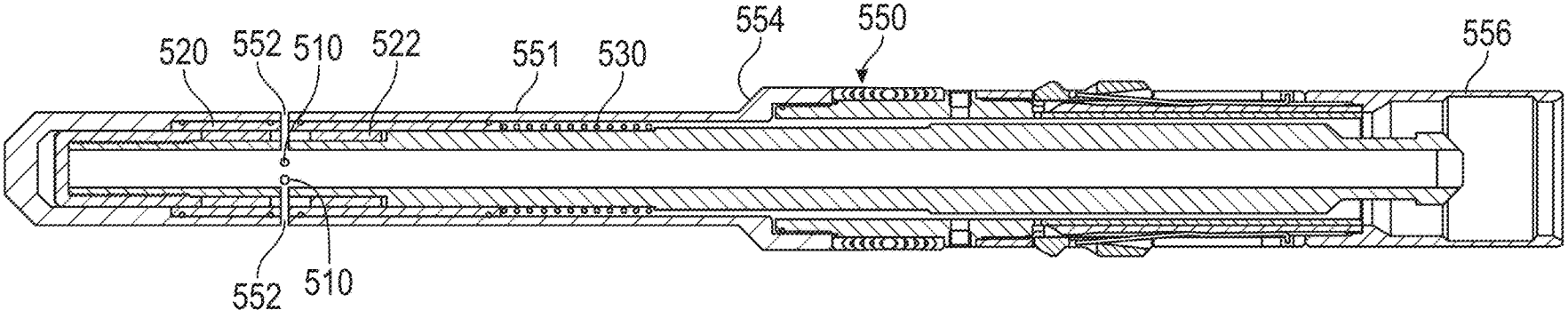
FIG. 22B shows the flow plug and spear of FIG. 22A with the spear fully inserted into the flow plug.

FIGS. 22A and 22B show the combination of the spear 500 of FIG. 20 and the flow plug assembly 551 of FIG. 21 as the spear 500 is inserted into the flow plug assembly 551. FIG. 22A shows the spear 500 partially inserted into the flow plug assembly 551 so that a first end of the hollow cylindrical shutter 520 has been brought into engagement with the shoulder 553 of the flow plug assembly 551. As the spear 500 is inserted further into the flow plug assembly 551, the shoulder 553 on the flow plug assembly 551 causes the shutter to move to an open position as depicted in FIG. 22B. When the hollow cylindrical shutter 520 is in the open position, vent passageways 525 on the hollow cylindrical shutter 520 align with the fluid supply passageways 510 of the spear 500 and with the flow passageways 552 of the flow plug assembly 551. This allows fluid from the interior of the spear 500 to flow out through the fluid supply passageways 510, through the vent passageways 525 of the hollow cylindrical shutter 520 and then through the flow passageways 552 of the flow plug 551 so that the fluid can be emitted into the wellbore.

When the hollow cylindrical shutter 520 is in the open position, the biasing member 530 has been compressed. When the spear 500 is withdrawn from the interior of the flow plug assembly 551, the biasing member 530 will cause the hollow cylindrical shutter 520 to return to the closed position, as depicted in FIG. 20. As a result, fluid from the interior of the spear 500 will no longer be allowed to flow out of the fluid supply passageways 510 of the spear 500.

Figure 23:
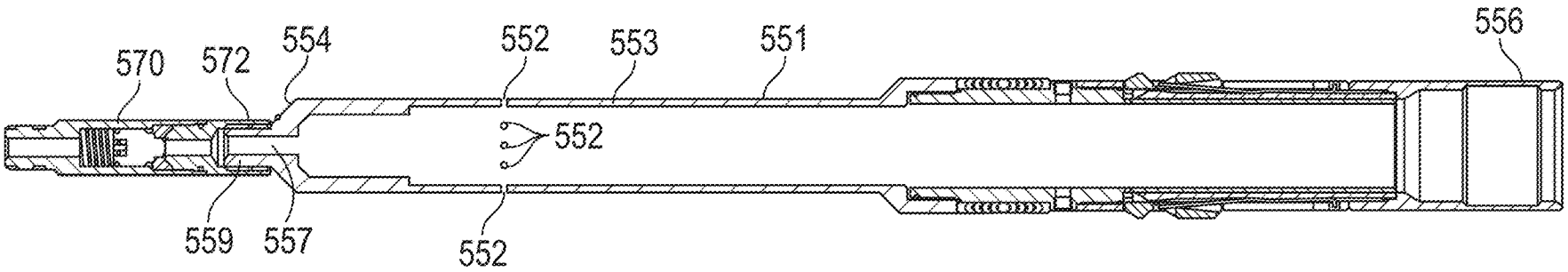
FIG. 23 is a sectional view of another embodiment of a flow plug which includes a valve.

FIG. 23 illustrates an alternate embodiment of a flow plug assembly 551 similar to the one depicted in FIG. 21. In the embodiment depicted in FIG. 23, a check valve 570 is attached to the first end 554 of the flow plug assembly 551. Interior threads 572 on the check valve engage exterior threads 559 on the second end 554 of the flow plug assembly 551 to attach the check valve 570 to the flow plug assembly 551. A flow passageway 557 on the second end 554 of the flow plug assembly 551 allows fluid in the interior of the flow plug assembly 551 to communicate with an interior of the check valve 570.

With the embodiment as depicted in FIG. 23, as the spear 500 is inserted into the interior of the flow plug assembly 551, any fluid in the interior of the of the flow plug 551 located ahead of the end of the spear 500 can be pushed out of the first end 554 of the flow plug assembly 551 through the check valve 570 to avoid hydraulic locking and insertion of the spear 500 into the interior of the flow plug assembly 551.

Figure 24:
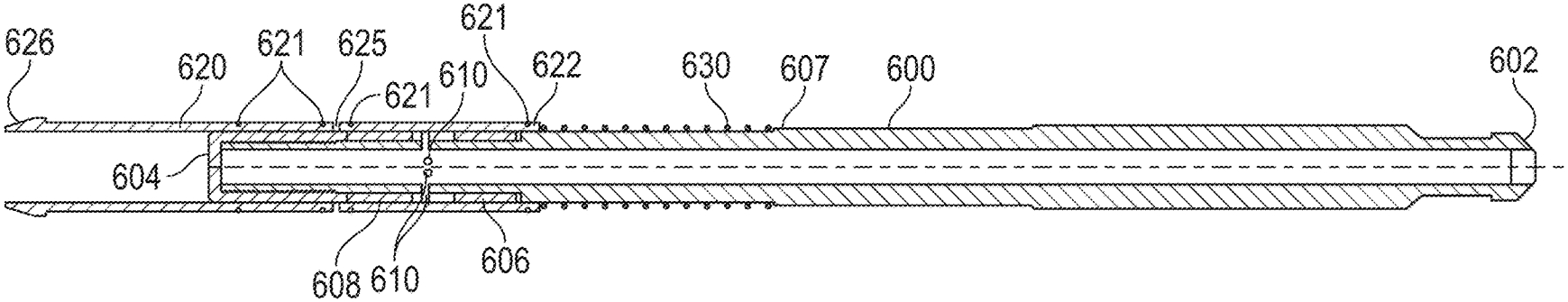
FIG. 24 is a sectional view of another embodiment of a spear including a cylindrical shutter mechanism.
Figure 25:
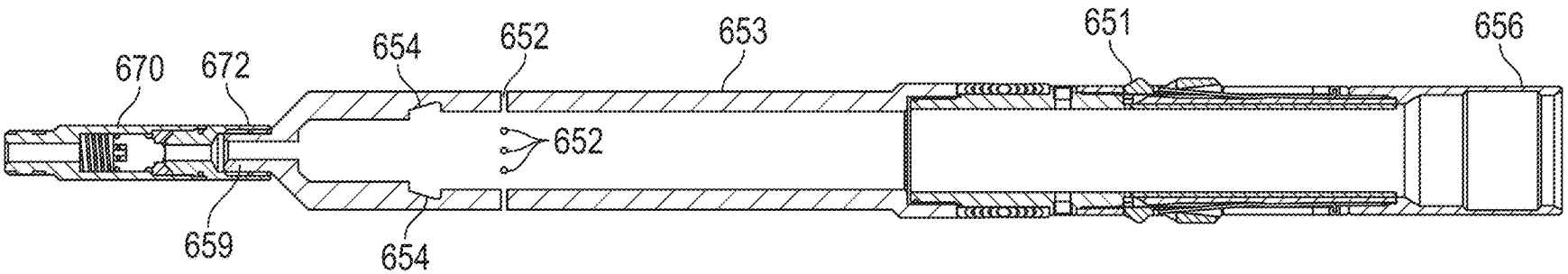
FIG. 25 is a sectional view of a flow plug which can be used in conjunction with the spear illustrated in FIG. 24 to form an assembly for delivering a fluid into a well.

FIGS. 24 and 25 depict another embodiment of a spear 600 and a flow plug assembly 653 which are similar in function to the spear and flow plug assembly depicted in FIGS. 20 and 21. In this embodiment, the hollow cylindrical shutter 620 includes a portion which extends beyond the first end 604 of the spear 600. The extending portion of the cylindrical shutter 620 includes a radial latching member 626 which protrudes radially outward from the exterior surface of the hollow cylindrical shutter 620. FIG. 24 shows the hollow cylindrical shutter 620 in the closed position, where the shutter 620 covers the fluid supply passageways 610 of the spear 600.

The flow plug assembly 653 depicted in FIG. 25 includes an annular aperture 654 formed on the inner cylindrical surface of the flow plug assembly 653. When the spear 600 is inserted into the flow plug assembly 653, the radial latching member 626 on the end of the hollow cylindrical shutter 620 is received in the annular aperture 654 of the flow plug assembly 653.

Figure 26A:
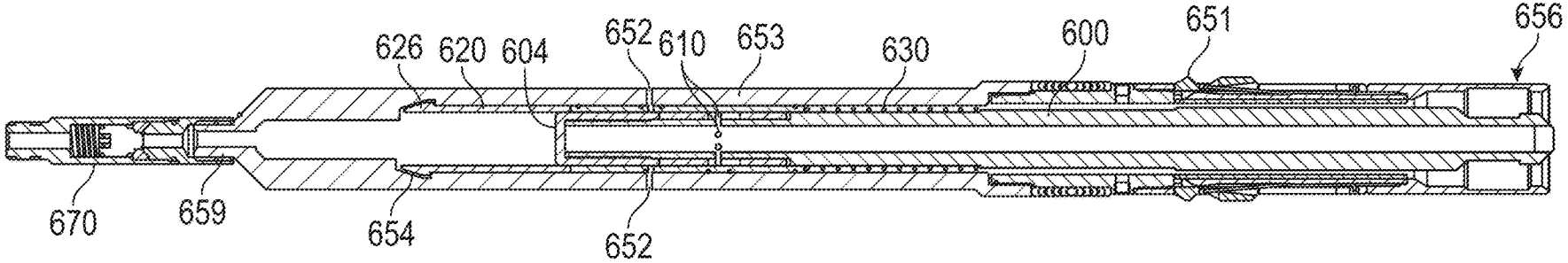
FIG. 26A shows the flow plug of FIG. 25 and the spear of FIG. 24 with the spear partially inserted into the flow plug.
Figure 26B:
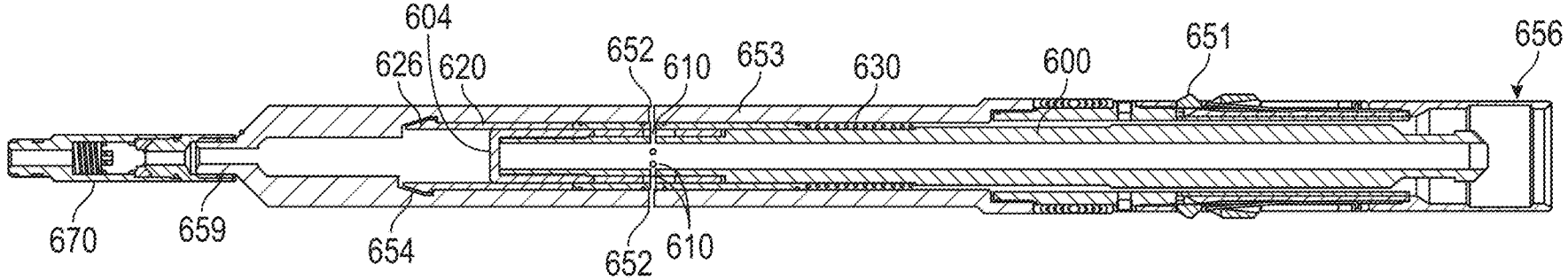
FIG. 26B shows the flow plug and spear combination of FIG. 26A with the spear fully inserted into the flow plug.

FIGS. 26A and 26B illustrate the spear 600 being inserted into the interior of the flow plug assembly 653. In FIG. 26A, the spear 600 is partially inserted into the interior of the flow plug assembly 653 such that the radial latching element 626 that projects outward from the end of the hollow cylindrical shutter 620 is seated in the annular aperture 654 of the flow plug assembly 653. FIG. 26B illustrates that once the spear 600 is fully inserted into the flow plug assembly 653, the hollow cylindrical shutter 620 is moved into an open position where vent apertures 625 of the hollow cylindrical shutter 620 are aligned with the radially extending fluid supply passageways 610 of the spear 600. The vent apertures 625 are also aligned with flow passageways 652 of the flow plug assembly 652. As a result, fluid from the interior of the spear 600 can flow out of the fluid supply passageway 610 through the vent passageways 625 and then out through the radially extending flow passageways 652 of the flow plug assembly 653.

In this embodiment, as the spear is withdrawn from the interior of the flow plug assembly 653, because the annular latching element 626 on the end of the cylindrical shutter 620 is lodged in the annular aperture 654 of the flow plug assembly 653, the hollow cylindrical shutter 620 is pulled into the closed position in conjunction with the biasing force provided by the spring 630. This ensures that the hollow cylindrical shutter 620 covers the fluid supply passageways 610 of the spear 600 once the spear 600 has been withdrawn from the flow plug assembly 653.

The leading angle and the wall thickness of the annular latching element 626 and the corresponding profile of the annular aperture 654 of the flow plug assembly 653 can be selectively varied to adjust the amount of force required to fully insert the spear 600 into the flow plug assembly 653. Similarly, the lagging angle and wall thickness of the annular latching element 626 and the corresponding profile of the annular aperture 654 of the flow plug assembly 653 can be selectively varied to adjust the amount of force required to remove or unseat the spear 600 from the flow plug assembly 653. Of course, the biasing element 630 also provides forces that must also be taken into account in adjusting for the desired insertion and removal forces.

Figure 27:
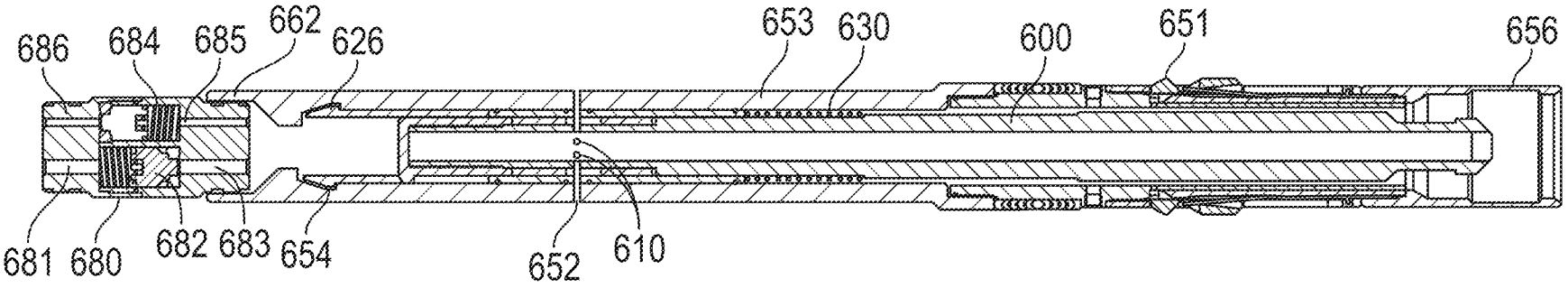
FIG. 27 is a sectional view of a flow plug and spear combination which includes a bidirectional check valve.

FIG. 27 illustrates another embodiment of a flow plug assembly 653 similar to the one depicted in FIG. 25. In this embodiment, a dual direction check valve 680 is attached to the first end 662 of the flow plug assembly 653. The dual direction check valve 680 includes a first fluid circuit which includes a first check valve 682 located between first and second fluid lines 683, 681. The dual direction check valve 680 also includes a second check valve 684 located between first and second fluid lines 685, 686. The dual direction check valve allow fluid to flow in both directions. However, it requires less force for the fluid to flow in a first direction than in a second direction.

The dual direction check valve 680 will operate in such a fashion that as the spear 600 is inserted into the flow plug assembly 653, fluid in the interior of the flow plug assembly 653 can be easily pushed through the first circuit of the dual direction check valve 680 that includes the fluid passageways 681 and 683 and the valve 682. In addition, as the spear 600 is withdrawn from the flow plug assembly 653, fluid from the exterior of the check valve can be drawn into the flow plug assembly 653 through the second circuit of the dual direction check valve 680 that includes the flow passageways 685 and 686 and the valve 684 to make it easier to withdraw the spear 600 from the interior of the flow plug assembly than if the check valve 680 were not present. However, it will require more force to cause the second valve 684 to open than is required to cause the first valve 682 open. This can tend to keep the spear seated within the flow plug assembly 653.

The foregoing descriptions related to the delivery and retrieval of a downhole capillary line for injection of fluid into a well. However, the systems and methods described above could be used for the delivery and retrieval of other downhole tools, such as pressure gauges and sensors. Thus, the foregoing descriptions should in no way be considered limiting.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

What is claimed is:

1. An assembly for delivering a fluid into a well, comprising:

a flow plug configured to be coupled to a production tube within a wellbore, the flow plug comprising:

a hollow cylindrical body, having a closed end and an open end; and a plurality of flow passageways that extend through the cylindrical body in a radial direction, the flow passageways being located adjacent the closed end; and a spear that is configured to be inserted into an interior of the hollow cylindrical body of the flow plug, the spear comprising:

a hollow cylindrical body having a first end and a second end that is configured to be attached to a fluid supply line such that fluid from the fluid supply line can flow into an interior of the hollow cylindrical body;

a plurality of fluid supply passageways that extend through the hollow cylindrical body in a radial direction, the plurality of fluid supply passageways being located such that when the spear is fully inserted into the hollow cylindrical body of the flow plug, fluid in the interior of the hollow cylindrical body of the spear can flow out of the fluid supply passageways and into the flow passageways of the flow plug;

a first sealing member located on an exterior of the hollow cylindrical body at a location between the plurality of fluid supply passageways and the second end of the hollow cylindrical body, the first sealing member being configured to form a seal between the exterior of the spear and an interior of the flow plug.

2. The assembly of claim 1, wherein the spear further comprises a second sealing member located on an exterior of the hollow cylindrical body at a location between the plurality of fluid supply passageways and the first end of the hollow cylindrical body of the spear, the second sealing member being configured to form a seal between the exterior of the spear and an interior of the flow plug.

3. The assembly of claim 1, wherein the flow plug further comprises a hollow cylindrical shutter that is slidably mounted in the interior of the hollow cylindrical body of the flow plug such that the shutter can move between a closed position at which the shutter blocks off the flow passageways and an open position at which the shutter exposes the flow passageways.

4. The assembly of claim 3, further comprising at least one circular seal positioned between an exterior cylindrical surface of the shutter and an interior cylindrical surface of hollow cylindrical body of the flow plug, wherein the at least one circular seal forms a fluid-tight seal between the exterior cylindrical surface of the shutter and the interior cylindrical surface of hollow cylindrical body of the flow plug.

5. The assembly of claim 3, further comprising a biasing member located in the interior of the hollow cylindrical body of the flow plug, wherein the biasing member biases the shutter to the closed position, and wherein when the spear is inserted into the flow plug, a bottom end of the spear pushes the shutter from the closed position to the open position against a biasing force of the biasing member.

6. The assembly of claim 5, wherein the biasing member comprises a coil spring, wherein the flow plug includes a post located at the closed end of the hollow cylindrical body, the post extending along a central longitudinal axis of the flow plus, and wherein the coil spring is positioned in an annular space between an exterior of the post and an interior cylindrical surface of the flow plug.

7. The assembly of claim 1, wherein the spear further comprises a hollow cylindrical shutter that is slidably mounted on the exterior of the hollow cylindrical body of the spear such that the shutter can move between a closed position at which the shutter covers the fluid supply passageways and an open position at which vent passageways of the shutter align with and expose the fluid supply passageways.

8. The assembly of claim 7, further comprising at least one circular seal located on an exterior cylindrical surface of the shutter, the at least one circular seal being configured to provide a fluid-tight seal between the exterior cylindrical surface of the shutter and an interior cylindrical surface of hollow cylindrical body of the flow plug.

9. The assembly of claim 8, wherein the first sealing member forms a seal between an exterior of the spear and an interior cylindrical surface of the shutter.

10. The assembly of claim 7, further comprising a biasing member located on an exterior of the hollow cylindrical body of the spear, wherein the biasing member biases the shutter to the closed position, and wherein when the spear is inserted into the flow plug, a shoulder on an inner cylindrical surface of the flow plug bears against a first end of the shutter and pushes the shutter from the closed position to the open position against a biasing force of the biasing member.

11. The assembly of claim 10, wherein the biasing member comprises a coil spring that surrounds the exterior of the spear, and wherein the coil spring is located between a second end of the shutter and a shoulder formed on the exterior of the spear.

12. The assembly of claim 7, wherein a first end of the hollow cylindrical shutter includes a latching element that projects radially outward from the first end of the hollow cylindrical shutter, wherein a cylindrical aperture is formed on an inner cylindrical surface of the hollow cylindrical body of the flow plug, and wherein when the spear is inserted into the flow plug, the latching element of the hollow cylindrical shutter is received in the cylindrical aperture of the flow plug.

13. The assembly of claim 12, wherein when the hollow cylindrical shutter is located in the closed position, a portion of the hollow cylindrical shutter having the latching element projects beyond the first end of the hollow cylindrical body of the spear.

14. The assembly of claim 1, further comprising a valve that is attached to the closed end of the hollow cylindrical body of the flow plug, wherein the valve is in fluid communication with an interior of the hollow cylindrical body of the flow plug.

15. The assembly of claim 14, wherein the valve is a check valve.

16. The assembly of claim 14, wherein the valve is a two-way check valve.

17. A spear that is configured to be attached to a fluid supply line and to deliver fluid from the fluid supply line into a flow plug mounted on a production tube within a wellbore, comprising:

a hollow cylindrical body having a first end and a second end that is configured to be attached to a fluid supply line such that fluid from the fluid supply line can flow into an interior of the hollow cylindrical body;

a plurality of fluid supply passageways that extend through the hollow cylindrical body in a radial direction, the plurality of fluid supply passageways being located adjacent the first end of the hollow cylindrical body;

a first sealing member located on an exterior of the hollow cylindrical body at a location between the plurality of fluid supply passageways and the second end of the hollow cylindrical body; and a hollow cylindrical shutter having vent passageways that is slidably mounted on the exterior of the hollow cylindrical body such that the shutter can move between a closed position at which the shutter covers the fluid supply passageways and an open position at which the vent passageways align with and expose the fluid supply passageways, and wherein the first sealing member forms a seal between the exterior of the hollow cylindrical body and an interior cylindrical surface of the shutter.

18. The assembly of claim 17, wherein the spear further comprises a second sealing member located on the exterior of the hollow cylindrical body at a location between the plurality of fluid supply passageways and the first end of the hollow cylindrical body, the second sealing member being configured to form a seal between the exterior of the hollow cylindrical body and the interior cylindrical surface of the shutter.

19. The assembly of claim 17, further comprising at least one circular seal located on an exterior cylindrical surface of the shutter, the at least one circular seal being configured to provide a fluid-tight seal between the exterior cylindrical surface of the shutter and an interior cylindrical surface of a flow plug.

20. The assembly of claim 17, further comprising a biasing member located on an exterior of the hollow cylindrical body, wherein the biasing member biases the shutter to the closed position, and wherein the shutter is configured such that when the spear is inserted into a flow plug, a shoulder on an inner cylindrical surface of the flow plug can bear against a first end of the shutter and push the shutter from the closed position to the open position against a biasing force of the biasing member.

21. The assembly of claim 20, wherein the biasing member comprises a coil spring that surrounds the exterior of the hollow cylindrical body, and wherein the coil spring is located between a second end of the shutter and a shoulder that protrudes from the exterior of the hollow cylindrical body.

22. The assembly of claim 17, wherein a first end of the hollow cylindrical shutter includes a latching element that projects radially outward from the first end of the hollow cylindrical shutter, wherein the latching element is configured such that when the spear is inserted into a flow plug, the latching element of the hollow cylindrical shutter is received in a cylindrical aperture of the flow plug.

23. The assembly of claim 22, wherein when the hollow cylindrical shutter is located in the closed position, a portion of the hollow cylindrical shutter having the latching element projects beyond the first end of the hollow cylindrical body of the spear.

* * * * *